US008153555B2

(12) United States Patent
Ieshige et al.

(10) Patent No.: US 8,153,555 B2
(45) Date of Patent: Apr. 10, 2012

(54) THERMAL TRANSFER SHEET

(75) Inventors: Munenori Ieshige, Tokyo (JP); Makoto Hashiba, Tokyo (JP); Kazutoshi Awano, Tokyo (JP)

(73) Assignee: Dai Nippon Printing Co., Ltd., Tokyo (JP)

( * ) Notice: Subject to any disclaimer, the term of this patent is extended or adjusted under 35 U.S.C. 154(b) by 367 days.

(21) Appl. No.: 12/443,535

(22) PCT Filed: Sep. 28, 2007

(86) PCT No.: PCT/JP2007/069062

§ 371 (c)(1), (2), (4) Date: May 28, 2009

(87) PCT Pub. No.: WO2008/038793

PCT Pub. Date: Apr. 3, 2008

(65) Prior Publication Data

US 2011/0045213 A1 Feb. 24, 2011

(30) Foreign Application Priority Data

| | | |
|---|---|---|
| Sep. 29, 2006 | (JP) | 2006-269958 |
| Sep. 29, 2006 | (JP) | 2006-269960 |
| Mar. 16, 2007 | (JP) | 2007-068505 |
| Mar. 27, 2007 | (JP) | 2007-082156 |

(51) Int. Cl.
*B41M 5/035* (2006.01)
*B41M 5/382* (2006.01)

(52) U.S. Cl. ..... 503/227; 428/32.66

(58) Field of Classification Search ..... None
See application file for complete search history.

(56) References Cited

U.S. PATENT DOCUMENTS

| | | | | |
|---|---|---|---|---|
| 7,244,691 | B2 * | 7/2007 | Massa et al. | 503/227 |
| 7,273,830 | B2 * | 9/2007 | Isaac et al. | 503/227 |
| 7,666,815 | B2 * | 2/2010 | Landry-Coltrain et al. | 503/227 |

FOREIGN PATENT DOCUMENTS

| | | | |
|---|---|---|---|
| JP | 1-234292 | | 9/1989 |
| JP | 4-014489 | | 1/1992 |
| JP | 4-175191 | | 6/1992 |
| JP | 6-247065 | | 9/1994 |
| JP | 7-149062 | | 6/1995 |
| JP | 9-175050 | A | 7/1997 |
| JP | 9-300827 | | 11/1997 |
| JP | 2000-225775 | | 8/2000 |
| JP | 2000-255172 | | 9/2000 |
| JP | 2001-205947 | A | 7/2001 |
| JP | 2002-011967 | | 1/2002 |
| JP | 2005-178210 | A | 7/2005 |
| JP | 2006-103300 | A | 4/2006 |

* cited by examiner

*Primary Examiner* — Bruce H Hess

(74) *Attorney, Agent, or Firm* — Connolly Bove Lodge & Hutz LLP

(57) ABSTRACT

It is an object of the present invention to provide a thermal transfer sheet provided with a heat resistant slipping layer which reduces dye retransfer, has excellent heat resistance and slip properties, and prevents the defects of printed image from being generated due to wrinkles and the like during printing.

A thermal transfer sheet comprising a base film, a color material layer on one surface of the base film, and a heat resistant slipping layer on the other surface of the base film, wherein the heat resistant slipping layer comprises a binder resin containing a cellulose acetate butyrate resin (A1) having a butyryl group content of 50% or more and a lubricant (B), the amount of the binder resin is 65 to 99% by weight of the total solid content of the heat resistant slipping layer, the amount of the cellulose acetate butyrate resin (A1) is 50 to 100% by weight of the binder resin, and the amount of the lubricant (B) is 1 to 30% by weight of the binder resin.

8 Claims, No Drawings

THERMAL TRANSFER SHEET

CROSS REFERENCE TO RELATED APPLICATIONS

This application is a National Stage of PCT/JP2007/069062 filed Sep. 28, 2007 which in turn claims priority from Japanese Application 2006-269958 filed Sep. 29, 2006, Japanese Application 2006-269960 filed Sep. 29, 2006, Japanese Application 2007-068505 filed Mar. 16, 2007 and Japanese Application 2007-082156 filed Mar. 27, 2007, the entire contents of which are incorporated herein by reference.

TECHNICAL FIELD

The present invention relates to a thermal transfer sheet.

BACKGROUND ART

As a thermal transfer sheet in a formation method of images using thermal transfer, a sublimation dye thermal transfer sheet in which a sublimation dye transfer ink layer composed of a sublimation dye and a binder is provided on one surface of a base film as a color material layer, and a thermofusible thermal transfer sheet in which a thermofusible transfer ink layer composed of a pigment and a wax is provided in place of the sublimation dye transfer ink layer are known. In these thermal transfer sheets, a protective layer to be transferred to a thermal transfer image-receiving sheet can also be further provided on the same face as in the color material layer of the base film as required.

In the thermal transfer sheet, generally, a heat resistant slipping layer (also referred to as a back layer) is provided on a surface opposite to the surface of a base film on which a color material layer is provided in order to stand heat energy from a thermal head, but when the thermal transfer sheet is stored in a wound state after printing, the color material layer is brought into contact with the heat resistant slipping layer and pressed against the heat resistant slipping layer under a pressure, and therefore a dye in the color material layer may be transferred (kick) to the heat resistant slipping layer. If the thermal transfer sheet is cut and rewound for processing the thermal transfer sheet into a finished product in such a state in which the dye of the color material layer has been transferred to the heat resistant slipping layer, the dye transferred to the heat resistant slipping layer may be transferred to other color material layer adjacent to this dye, that is, retransfer may occur (back). If the retransfer occurs like this, an image-receiving sheet has different color hue from designated color when the color material layer contaminated with the retransfer is thermally transferred to the image-receiving sheet and printing precision is significantly impaired. This is further remarkable in a case where a transfer protective layer is provided beside the color material layer. That is, since this protective layer is a transparent film to avoid impairing image characteristics, the dye is retransferred to this transparent film, and when this contaminated transparent film is transferred on the images as a protective film, the contamination due to the dye is further emphasized to impair the printing precision significantly.

On the other hand, it is required that the heat energy of the thermal head is increased, the sensitivity of an ink ribbon is enhanced, the content of a dye is increased and the like with accompanying speeding up of printers in recent years, but these changes increase the possibility of transferring the dye from the color material layer to the heat resistant slipping layer and causing troubles during thermal transfer resulting from this transfer. Therefore, requirements for the heat resistant slipping layer to reduce dye retransfer have been further increased.

As a heat resistant slipping layer reducing the dye retransfer, there are proposed, for example, a heat resistant slipping layer (for example, see patent document 1) which contains a phosphate ester having a melting point of 35° C. or higher in an amount of 5 to 50 parts by weight and contains a polyvinyl acetal resin having a glass transition temperature of 80° C. or higher; a heat resistant slipping layer (for example, see patent document 2) which contains a binder resin such as a thermoplastic resin, a lubricant having a thermal cracking temperature of 200° C. or higher, and particles having a Mohs' hardness of less than 3 and reduces wear of the thermal head; a heat resistant slipping layer (for example, see patent document 3) which is predominantly formed of a reaction product of an active hydrogen-containing thermoplastic resin such as a polyvinyl butyral resin with isocyanate and is superior in an antistatic property; and a heat resistant slipping layer (for example, see patent document 4) which contains a natural organic polymer powder and molybdenum disulfide and can prevent wear of the surface of the thermal head. However, a thermal transfer sheet in which the dye retransfer is reduced by selecting a cellulosic resin as a binder resin of the heat resistant slipping layer is not described in any patent document.

Furthermore, there are also proposed a heat resistant slipping layer (for example, see patent document 5) which includes a cellulose acetate butyrate resin containing 5 to 50% of a propyl group and 10 to 45% of a butyl group and improves heat resistance; a heat resistant slipping layer (for example, see patent document 6) in which roughness (SRz) is limited to 3.0 μm or more; and a heat resistant slipping layer (for example, see patent document 7) formed of a mixture of a heat resistant resin, a lubricant having a melting point of 33° C. or higher and an IO value of 0.23 or more, and a polyisocyanate compound having two or more isocyanate groups in its molecule; but it is not described and suggested that the content of a butyryl group in the cellulose acetate butyrate resin is specified with respect to reduction of the dye retransfer.

Patent Document 1: Japanese Kokai Publication Hei-9-300827

Patent Document 2: Japanese Kokai Publication Hei-6-247065

Patent Document 3: Japanese Kokai Publication Hei-7-149062

Patent Document 4: Japanese Kokai Publication 2000-255172

Patent Document 5: Japanese Kokai Publication Hei-1-234292

Patent Document 6: Japanese Kokai Publication 2000-225775

Patent Document 7: Japanese Kokai Publication 2002-11967

DISCLOSURE OF THE INVENTION

Problems to be Solved by the Invention

In view of the above-mentioned state of the art, it is an object of the present invention to provide a thermal transfer sheet provided with a heat resistant slipping layer which reduces dye retransfer, has excellent heat resistance and slip properties, and prevents the defects of printed image from being generated due to wrinkles and the like during printing.

Means for Solving the Problems

The present invention relates to a heat transfer sheet comprising a base film, a color material layer on one surface of the base film, and a heat resistant slipping layer on the other surface of the base film, wherein the heat resistant slipping layer includes a binder resin containing a cellulose acetate butyrate resin (A1) having a butyryl group content of 50% or higher and a lubricant (B), the amount of the binder resin is 65 to 99% by weight of the total solid content of the heat resistant slipping layer, the amount of the cellulose acetate butyrate resin (A1) is 50 to 100% by weight of the binder resin and the amount of the lubricant (B) is 1 to 30% by weight of the binder resin.

Preferably, the above binder resin further contains at least one resin (A2) selected from the group consisting of acrylic resins and polyvinyl acetal resins, and the amount of the cellulose acetate butyrate resin (A1) is 60 to 90% by weight of the total weight of the cellulose acetate butyrate resin (A1) and the above resin (A2).

Preferably, the above heat resistant slipping layer comprises at least one selected from the group consisting of metallic soaps, silicone oils, silicone modified resins, and phosphate esters as a lubricant (B).

Preferably, the heat resistant slipping layer comprises fillers.

Preferably, in the heat resistant slipping layer, the binder resin is crosslinked by an action of isocyanate.

Hereinafter, the present invention will be described in detail.

The present inventors have completed the thermal transfer sheet of the present invention for the first time by finding that (1) a cellulose acetate butyrate [CAB] resin having a butyryl group content of 50% or more can reduce dye retransfer in the thermal transfer sheet and (2) the dye retransfer can be reduced by setting the amount of the above binder resin at 65 to 99% by weight of the total solid content of the heat resistant slipping layer and by setting the amount of the CAB resin at 50 to 100% by weight of the binder resin of the heat resistant slipping layer.

It has been known that the heat resistance of the CAB resin generally varies depending on the content of its butyryl groups or acetyl groups, but it has not been known that these contents have an effect on the dye retransfer in the thermal transfer sheet. On the other hand, the thermal transfer sheet of the present invention can reduce the retransfer of the dye transferred from the color material layer to the heat resistant slipping layer to a transfer protective layer resulting from retransfer by using the CAB resin, in which the content of the butyryl group is within the above range, in an amount within the above range as the binder resin of the heat resistant slipping layer.

Furthermore, the present inventors have also found that the dye transfer (kick) from the color material layer to the heat resistant slipping layer can be suppressed by containing at least one resin (A2) selected from the group consisting of acrylic resins and polyvinyl acetal resins as the binder resin of the heat resistant slipping layer.

That is, when the thermal transfer sheet of the present invention includes the above resin (A2), it has not only very low color-transfer (back) to the protective layer or the like resulting from the dye retransfer, but also low dye transfer (kick) to the heat resistant slipping layer, and is superior in color reproducibility and can suitably reproduce color hue in a low print density region even if the thermal transfer sheet is used after storing. That is, when the dye transfer (kick) from the color material layer to the heat resistant slipping layer is significant, the print density in a low density region tends to decrease in the resulting printed matter and color reproducibility is lost, but by containing the resin (A2), the dye transfer to the heat resistant slipping layer can be suppressed and reduction of the print density in a low density region can be inhibited to maintain the color reproducibility.

Mechanism, in which the thermal transfer sheet performs such an effect based on the concurrent use of the resin (A1) and the resin (A2), is not clear, but on an effect based on the use of the resin (A2), it is thought that the dye transfer to the heat resistant slipping layer is suppressed because of difference between the affinity of a dye and a dye for the binder resin and the affinity of a dye and the resin (A2) of the heat resistant slipping layer.

Hereinafter, each layer constituting the thermal transfer sheet of the present invention will be described in detail.

(Base Film)

As a base film in the present invention, any material may be used as long as it is a publicly known material having a certain level of heat resistance and strength, and examples of the base film include resin films such as polyethylene terephthalate films, 1,4-polycyclohexylene dimethylene terephthalate films, polyethylene naphthalate films, polyphenylene sulfide films, polystyrene films, polypropylene films, polysulfone films, aramide films, polycarbonate films, polyvinyl alcohol films, cellophane, cellulose derivatives such as cellulose acetate, polyethylene films, polyvinyl chloride films, nylon films, polyimide films and ionomer films; papers such as capacitor papers, paraffin papers, synthetic papers and the like; nonwoven fabrics; composites of papers or nonwoven fabrics and resins; and the like.

The above base film generally has a thickness of about 0.5 to 50 μm, and preferably about 3 to 10 μm.

The base film may be subjected to surface treatment in order to improve the adhesiveness of the base film to an adjacent layer. As the surface treatment, publicly known techniques for modifying the resin surface, such as corona discharge treatment, flame treatment, ozone treatment, ultraviolet treatment, radiation treatment, etching treatment, chemical treatment, plasma treatment, low temperature plasma treatment, and grafting treatment, can be applied. The above surface treatment may be used singly, or may be used in combination of two or more surface treatments.

In the present invention, among the above surface treatments, corona discharge treatment and plasma treatment are preferred because of low cost. Further, an under coat layer (primer layer) may be formed on one surface or both surfaces of the base film as required.

(Heat Resistant Slipping Layer)

The thermal transfer sheet of the present invention includes a heat resistant slipping layer on a surface opposite to the surface of the base film on which the color material layer is provided.

The above heat resistant slipping layer includes the binder resin containing the CAB resin (A1) and the lubricant (B).

The amount of the above binder resin containing the CAB resin (A1) is generally 65 to 99% by weight of the total solid content of the heat resistant slipping layer from the viewpoint of retaining other components such as a solid lubricant and fillers and coat strength, and preferably 65 to 95% by weight.

The CAB resin (A1) generally has a butyryl group content of 50% or more from the viewpoint of reducing the dye retransfer.

In the present specification, the above butyryl group content is the content of a butyryl group contained in triester composing the CAB resin (A1), expressed by weight percent.

The butyryl group content is a value measured according to ASTM Standard D817.

The CAB resin (A1) preferably has a number average molecular weight of about 10000 to 100000, and more preferably 15000 to 60000.

The above number average molecular weight is a value measured with size exclusion chromatography (SEC, reference material: polystyrene).

The CAB resin (A1) may have a glass transition temperature (Tg) of 80° C. or higher from the viewpoint of heat resistance and strength.

The amount of the CAB resin (A1) is preferably 50 to 100% by weight of the above binder resin, and more preferably 70 to 100% by weigh of the binder resin.

When the content of the CAB resin (A1) is less than the above range, the dye retransfer becomes high and printing precision may be significantly impaired.

The above content of the CAB resin (A1) is a value obtained in terms of the total solid content of each of the materials to be added as the binder resin of the heat resistant slipping layer.

The heat resistant slipping layer in the present invention may include other thermoplastic resins in addition to the CAB resin (A1) as the binder resin in a range which does not impair the effect of reducing the dye retransfer.

Examples of the above thermoplastic resin include cellulose acetate butyrate resins in which the content of a butyryl group is out of the above range, other cellulosic resins, acrylic resins, polyurethane resins, polyester resins, epoxy resins, polyacetal resins, polyvinylacetal resins, polycarbonate resins, polyimide resins and the like. Among them, acrylic resins, polyvinylacetal resins, polyurethane resins and polyester resins are preferable, and acrylic resins and polyvinylacetal resins are more preferable.

Preferably, the binder resin further contains at least one resin (A2) selected from the group consisting of acrylic resins and polyvinyl acetal resins.

The above acrylic resins may be acrylic resins or may be acrylic derivatives such as methacrylic resins. Examples of the acrylic resins include polymethyl methacrylate, polyacrylamide, an acrylpolyol resin, a styrene-acrylic copolymer, and the like, and among them, polymethyl methacrylate is preferable. In addition, the acrylic resin as the resin (A2) does not contain a silicone modified acrylic resin.

Examples of the above polyvinyl acetal resins include polyvinyl butyral, polyvinyl acetoacetal, and the like.

The resin (A2) preferably has a glass transition temperature (Tg) of 60° C. or higher, and more preferably 70° C. or higher in view of storing temperature of an ink ribbon.

As the resin (A2), one or more resins may be used. When two or more resins are used as the resin (A2), for example, two or more acrylic resins or two or more polyvinyl acetal resins may be used, or the acrylic resin may be used in combination with the polyvinyl acetal resin.

In the present invention, the resin (A2) is more preferably an acrylic resin.

When the heat resistant slipping layer includes the CAB resin (A1) and the above resin (A2), the amount of the CAB resin (A1) is preferably 60 to 90% by weight of the total weight of the CAB resin (A1) and the resin (A2).

When the heat resistant slipping layer includes the CAB resin (A1) and the resin (A2), if the content of the CAB resin (A1) is more than the above range, the dye transfer (kick) from the color material layer to the heat resistant slipping layer increases and therefore a thermal head may be contaminated or the color developing property of a portion printed with low energy may vary. Further, if the content thereof is less than the above range, the kick can be effectively prevented, but most of the dye kicked onto the heat resistant slipping layer is retransferred (backed) to the color material layer or the protective layer and therefore printed matters may have different color hue from designated color.

The above content of the CAB resin (A1) is a value determined from a ratio of the solid weight of the CAB resin (A1) to the total solid weight of the CAB resin (A1) and the resin (A2).

The above lubricant (B) is added for the purpose of improving slip properties of the heat resistant slipping layer and the amount of the lubricant (B) is 1 to 30 parts by weight with respect to 100 parts by weight of the total amount of the binder resin.

The thermal transfer sheet of the present invention can exhibit adequate slip properties by optimizing an amount of the lubricant to be added even when the thermal transfer sheet includes one lubricant as the lubricant (B), but the thermal transfer sheet can attain more stable slip properties in an extended range from low printing energy to high printing energy by using a plurality of lubricants in combination as the lubricant (B).

In addition, when the thermal transfer sheet of the present invention includes a plurality of different types of lubricants as the lubricant (B), the content of the above lubricant (B) refers to the sum of the contents of each of the lubricants The lubricant (B) is preferably a substance including at least one selected from the group consisting of metallic soaps, silicone oils, silicone modified resins, and phosphate esters, and phosphate esters and silicone oils are more preferable in point of enabling to exhibit excellent slip properties in an extended range from low printing energy to high printing energy as described later.

Examples of the above metallic soaps include a polyvalent metallic salt (b1) of alkyl phosphate ester, a metallic salt (b2) of alkylcarboxylic acid and the like.

As the above polyvalent metallic salt (b1) of alkyl phosphate ester, a metallic salt which is publicly known as additives for plastics may be used.

The polyvalent metallic salt (b1) of alkyl phosphate ester is generally obtained by substituting alkali-metal salts of alkyl phosphate esters with polyvalent metals, and salts in various grades are commercially available.

The polyvalent metallic salt (b1) of alkyl phosphate ester in the present invention is preferably expressed, for example, by the following structural formula 1:

[Formula 1]

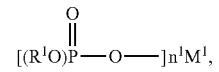

1 or the following structural formula 2:

[Formula 2]

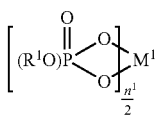

2 wherein $R^1$ represents an alkyl group having 12 or more carbon atoms, $M^1$ represents an alkali-earth metal, zinc or aluminum, and $n^1$ represents the valence of $M^1$.

$R^1$ is preferably an alkyl group having 12 to 18 carbon atoms. Examples of $R^1$ include a cetyl group, a lauryl group, a stearyl group and the like, but particularly a stearyl group is preferable from the viewpoint of cost and of avoiding a problem of contamination such as bleeding out.

Examples of the alkali-earth metals denoted by $M^1$ include barium, calcium, magnesium and the like.

Examples of the above metallic salt (b2) of alkylcarboxylic acid include compounds expressed by the following structural formula 3:

[Formula 3]

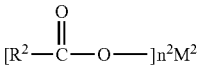

3 wherein $R^2$ represents an alkyl group having 11 or more carbon atoms, $M^2$ represents an alkali-earth metal, zinc, aluminum or lithium, and $n^2$ represents the valence of $M^2$.

$R^2$ is preferably an alkyl group having 11 to 18 carbon atoms. Examples of $R^2$ include a dodecyl group, a hexadecyl group, a heptadecyl group, a stearyle group and the like, but a dodecyl group, a heptadecyl group and a stearyle group are preferable and a stearyle group is more preferable from the viewpoint of cost and unavailability as an industrial product, and the viewpoint of avoiding a problem of contamination such as bleeding out.

Examples of the alkali-earth metals denoted by $M^2$ include barium, calcium, magnesium and the like.

The polyvalent metallic salt (b1) of alkyl phosphate ester and the metallic salt (b2) of alkylcarboxylic acid can exhibit slip properties particularly in a high printing energy region, and in point of a slip property, magnesium compounds, zinc compounds, or aluminum compounds are preferable and zinc compounds are more preferable.

Each of the (b1) and the (b2) preferably has an average particle size of 3 to 20 μm, and more preferably 3 to 15 μm.

If the average particle size is too large, the staining on printed image is apt to occur, and if it is too small, adequate slip properties cannot be obtained in the heat resistant slipping layer and therefore a problem such as wrinkles in printed image may arise.

The total amount of the (b1) and/or the (b2) is preferably 1 to 30 parts by weight, and more preferably 5 to 20 parts by weight with respect to 100 parts by weight of the total amount of the binder resin.

If the total amount of the above (b1) and/or the above (b2) to be used is less than the above range, an adequate releasing property from the thermal head is not exhibited in applying heat and the thermal transfer sheet tends to fuse with the thermal head. On the other hand, if the total amount is more than the above range, the physical strength or the heat resistance of the heat resistant slipping layer may be deteriorated.

In the thermal transfer sheet of the present invention, when the above phosphate ester (b3) is used as the lubricant (B), excellent slip properties can be exhibited in an extended range from low printing energy to high printing energy.

Examples of the phosphate ester (b3) include (1) phosphate monoester or diester of saturated or unsaturated higher alcohol having 6 to 20 carbon atoms, (2) phosphate monoester or diester such as polyoxyalkylene alkyl ether or polyoxyalkylene alkyl allyl ether, (3) phosphate monoester or diester of alkyleneoxide adduct (the average molar number of addition: 1 to 8) of the above saturated or unsaturated higher alcohol, and (4) phosphate monoester or diester such as alkylphenol or alkylnaphthol having an alkyl group having 8 to 12 carbon atoms, and the like.

Examples of the saturated or unsaturated higher alcohol in the above (1) and (3) include cetyl alcohol, stearyl alcohol, oleyl alcohol and the like.

Examples of the alkylphenol in the above (3) include nonylphenol, dodecylphenol, diphenylphenol and the like.

In a mixing ratio, the amount of the phosphate ester (b3) is preferably 1 to 30 parts by weight, and more preferably 1 to 10 parts by weight with respect to 100 parts by weight of the total amount of the binder resin. When the mixing ratio is less than the above range, adequate slip properties cannot be attained, and when the mixing ratio is more than the above range, contamination due to a dye may increase.

When the phosphate ester (b3) is used, an alkaline substance may be used together so that the thermal head is not corroded due to an acid produced by the degradation of phosphate ester during printing.

Examples of the above alkaline substance include oxides or hydroxides of alkaline metal or alkaline-earth metal, and organic amines and the like.

As the above oxides or hydroxides of alkaline metal or alkaline-earth metal, magnesium hydroxide, magnesium oxide, hydrotalcite, aluminum hydroxide, magnesium silicate, magnesium carbonate, alumina hydroxide, and magnesium aluminum glycinate, and the like are preferable, and magnesium hydroxide is more preferable.

As the above organic amine, those which are nonvolatile at ordinary temperature and have a boiling point of 200° C. or higher are preferable, and examples thereof include mono-, di-, and trimethylamine, and mono-, di-, and triethylamine, and mono-, di-, and tripropylamine and the like.

The alkaline substance is preferably used within a range from 0.1 to 10 mole with respect to 1 mole of the phosphate ester (b3)

In the thermal transfer sheet of the present invention, when the above silicone modified resin (b4) is used as the lubricant (B), excellent slip properties can be exhibited particularly in a low printing energy region. The above silicone modified resin (b4) means a resin having a polysiloxane group in a part of the molecule.

The silicone modified resin (b4) can be prepared by a publicly known method such as copolymerization of a polysiloxane group-containing vinyl monomer with another kind of vinyl monomer and a reaction of a thermoplastic resin with reactive silicone.

As the silicone modified resin (b4), those which are prepared by a method of block-copolymerizing a thermoplastic resin with a polysiloxane group-containing vinyl monomer, a method of graft-copolymerizing a thermoplastic resin with a polysiloxane group-containing vinyl monomer, or a method of reacting a thermoplastic resin with reactive silicone, are preferable.

Examples of the above thermoplastic resin include acrylic resins, polyurethane resins, polyester resins, epoxy resins, polyacetal resins, polycarbonate resins, polyimide resins and the like, and among them, acrylic resins, polyurethane resins and polyester resins are preferable.

The above reactive silicone is a compound having a polysiloxane structure in the main chain and having a reactive functional group, which reacts with a functional group of a thermoplastic resin, at one end or both ends.

Examples of the above reactive functional group include an amino group, a hydroxyl group, an epoxy group, a vinyl group, a carboxyl group and the like.

The amount of the above silicone modified resin (b4) is preferably 1 to 30 parts by weight, and more preferably 1 to 20 parts by weight with respect to 100 parts by weight of the total amount of the binder resin.

If the amount of the silicone modified resin (b4) is less than the above range, an adequate releasing property from the thermal head cannot be attained in applying heat and the thermal transfer sheet tends to fuse with the thermal head. On the other hand, if the amount is more than the above range, contamination due to a dye may increase.

In the thermal transfer sheet of the present invention, when the above silicone oil (b5) is used as the lubricant (B), excellent slip properties can be exhibited in an extended range from low printing energy to high printing energy.

The silicone oil (b5) may be publicly known silicone oil and modified silicone oil may be used or a unmodified silicone oil may be used.

The above modified silicone oil preferably has a dimethylpolysiloxane structure in the main chain and is preferably a compound in which a part of a methyl group is substituted with a reactive functional group or a polyether group.

The modified silicone oil is further classified into reactive silicone oils and unreactive silicone oils.

Examples of the above reactive silicone oils generally include silicone oils having the above reactive functional group such as amino modified silicone oils, epoxy modified silicone oils, and carboxyl modified silicone oils.

The above unreactive silicone oils are particularly superior in compatibility and reactivity, and examples thereof include polyether modified silicone oils.

The above unmodified silicone oil generally has a methyl group, a phenyl group or a hydrogen atom coupled as a substituent and is superior in heat resistance and lubricity. Examples of the unmodified silicone oil include dimethyl silicone oil and methyl phenyl silicone oil.

As the above silicone oil, dimethylpolyoxysiloxane and modified products thereof are preferable.

The amount of the silicone oil (b5) is preferably 1 to 30 parts by weight, and more preferably 1 to 10 parts by weight with respect to 100 parts by weight of the total amount of the binder resin.

When the amount of the silicone oil (b5) is less than the above range, a releasing property from the thermal head cannot be attained and the thermal transfer sheet tends to fuse with the thermal head.

On the other hand, when the amount is more than the above range, the dye transfer increases or the thermal head is contaminated during printing.

The heat resistant slipping layer in the present invention may contain fillers in addition to the binder resin and the lubricant (B) described above, for the purpose of adjusting the ability of foreign matter deposited on the thermal head to be cleaned and the slip properties, preventing blocking and the like.

Examples of the above fillers include talc, kaolin, mica, graphite, calcium carbonate, molybdenum disulfide, a silicone rubber filler, a benzoguanamine resin, a melamine-formaldehyde condensate, and the like, and among them, talc, a silicone rubber filler and calcium carbonate are preferable.

The average particle size of the above filler may vary in accordance with the thickness of a heat resistant slipping layer to be formed and is not particularly limited, but they are preferably ultrafine particles generally having an average particle size from about 0.01 to 15 μm.

If the average particle size of the filler is more than the above range, it may lead to an abrasion of the thermal head easily and to significant increase of defects at the image-printed face due to the fillers detached from the heat resistant slipping layer easily. If the average particle size of the filler is less than the above range, it may lead to deterioration in cleaning properties when the foreign matter is deposited on the thermal head.

Particle sizes of the lubricant and the filler in the present invention are average particle sizes measured by laser diffraction/scattering methods.

When an amount of the fillers to be added is 1 to 30 parts by weight with respect to 100 parts by weight of the total amount of the binder resin, the slip properties and cleaning properties described above are excellent, and the amount of the fillers is particularly preferable in a range from 1 to 20 parts by weight.

An amount less than the above range may not improve the cleaning properties, and an amount exceeding the above range may lead to deterioration in flexibility and film strength of the heat resistant slipping layer.

In the above heat resistant slipping layer, the binder resin may be crosslinked by an action of isocyanate.

The isocyanate in the present invention is not particularly limited, and examples thereof include adducts of aromatic polyisocyanate described in Japanese Kokai Publication Hei-7-149062, and silicone modified isocyanate compounds.

The amount of the above isocyanate to be used is preferably 1 to 20 parts by weight with respect to 100 parts by weight of the total amount of the binder resin from the viewpoint of crosslinking strength and reducing the dye retransfer.

The above heat resistant slipping layer is formed by dissolving or dispersing the above binder resin such as the CAB resin (A1) and the lubricant (B), and fillers, isocyanate or the like to be added as required in a solvent to prepare a coating liquid, and then applying the resulting coating liquid by a common coating means such as a gravure coater, a roll coater, and a wire bar, and drying the coating liquid.

The amount of the heat resistant slipping layer to be coated is preferably 2.0 $g/m^2$ or less on a dry solid basis from the viewpoint of forming a heat resistant slipping layer having adequate performance.

The amount of the heat resistant slipping layer to be coated is more preferably 0.1 to 1.5 $g/m^2$, and furthermore preferably 0.2 to 1.0 $g/m^2$ on a dry solid basis.

When the thickness of the heat resistant slipping layer is excessively small, functions of the heat resistant slipping layer can not be exhibited adequately, and when the thickness is excessively large, the sensitivity at the time of printing may be deteriorated.

(Color Material Layer)

When desired images are in monochrome, in the thermal transfer sheet of the present invention, only a layer of one color appropriately selected may be formed as a color material layer, and when desired images are in full color, the color material layer of cyan, magenta and yellow (further, black as required) may be formed as a color material layer by selecting cyan, magenta and yellow (further, black as required).

When the thermal transfer sheet of the present invention is a sublimation dye thermal transfer sheet, a layer including a sublimation dye is formed as a color material layer, and when the thermal transfer sheet of the present invention is a thermofusible thermal transfer sheet, a thermofusible ink layer colored, for example, with a pigment or the like is formed as a color material layer.

Hereinafter, the present invention will be described, taking a sublimation dye thermal transfer sheet as an example, but the present invention is not limited only to the sublimation dye thermal transfer sheet.

Sublimation dyes used for a sublimation type color material layer are not particularly limited, and publicly known dyes may be employed.

Examples of the above sublimation dyes include diaryl methane dyes; triaryl methane dyes; thiazole dyes; merocyanine dyes; pyrazolone dyes; methyne dyes; indoaniline dye; azomethine dyes such as acetophenoneazomethine, pyrazoloazomethine, imidazoleazomethine, imidazoazomethine, and pyridoneazomethine; xanthene dyes; oxazine dyes; cyanostyrene dyes such as dicyanostyrene and tricyanostyrene; thiazine dyes; azine dyes; acridine dyes; benzeneazo dye; azo dyes such as pyridoneazo, thiopheneazo, isothiazoleazo, pyrroleazo, pyrazoleazo, imidazoleazo, thiadiazoleazo, triazoleazo and disazo; spiropyran dyes; indolinospiropyran dyes; fluoran dyes; rhodaminelactam dyes; naphthoquinone dyes; anthraquinone dyes; and quinophthalone dyes; and the like, and more specific examples thereof include compounds exemplified in Japanese Kokai Publication Hei-7-149062 and the like.

In the color material layer, the amount of the sublimation dye is 5 to 90% by weight, and preferably 10 to 70% by weight with respect to the total solid content of the color material layer.

If the amount of the sublimation dye to be used is less than the above range, a print density may become low, and if the amount of the sublimation dye to be used is more than the above range, a preserving property may be deteriorated.

As a binder resin to support the dye, generally, a resin having heat resistance and having moderate affinity with the dye can be used.

Examples of the above binder resin include cellulosic resins such as ethylcellulose, hydroxyethylcellulose, ethylhydroxycellose, hydroxypropylcellulose, methylcellulose, cellulose acetate, and cellulose butyrate; vinyl resins such as polyvinyl alcohol, polyvinyl acetate, polyvinyl butyral, polyvinylacetoacetal, and polyvinylpyrrolidone; acrylic resins such as poly(meth)acrylate and poly(meta)acrylamide; polyurethane resins; polyamide resins; polyester resins; and the like.

As the binder resin, among them, cellulosic resins, vinyl resins, acrylic resins, urethane resins, polyester resins and the like are preferable from the viewpoints of heat resistance and dye transfer, and polyvinyl butyral, polyvinylacetoacetal and the like are more preferable.

Additives such as a mold release agent, inorganic particles, or organic particles may be used as desired for the above color material layer.

Examples of the mold release agent include silicone oils, phosphate esters and the like.

Examples of the inorganic particles include carbon black, aluminum, molybdenum disulfide, and the like.

Examples of the organic particles include polyethylene wax, and the like.

The color material layer can be formed by dissolving or dispersing the above dye and the above binder together with the additives to be added as required in a proper organic solvent or water to prepare a coating liquid and then applying the coating liquid onto one surface of the above base film by a publicly known means such as a gravure printing method, a screen printing method and a reverse roll coating printing method which uses a gravure and drying the coating liquid.

Examples of the organic solvent include toluene, methylethylketone, ethanol, isopropyl alcohol, cyclohexanone, dimethylformamide [DME] and the like.

The amount of the above color material layer to be coated is 0.2 to 6.0 g/m$^2$, and preferably about 0.2 to 3.0 g/m$^2$ on a dry solid basis.

(Others)

The heat transfer sheet of the present invention may be provided with an adhesive layer, a peeling layer and a release layer as a transfer protective layer; a under coat layer; or another layer as long as it includes a base film, a color material layer provided on one surface of the base film, and a heat resistant slipping layer provided on the other surface of the base film.

When the above transfer protective layer and the above-mentioned color material layer are formed in order on a face, a protective layer which protects an image surface can be transferred after forming images.

The constitution and the preparation of the transfer protective layer are not particularly limited and they can be selected from publicly known techniques in accordance with features of a base film or a color material layer or the like to be used.

The above under coat layer is not particularly limited, and it can be provided by appropriately selecting the composition which improves the adhesiveness between the base film and the color material layer, and the transfer efficiency of a dye.

The thermal transfer sheet of the present invention can print by heating and pressurizing a prescribed portion of the side of the base film on which a heat resistant slipping layer is provided by a thermal head or the like to transfer a dye at a location corresponding to a printed area of a color material layer to a material to which a dye is transferred.

When the thermal transfer sheet of the present invention is a sublimation dye transfer printing sheet, a thermal transfer image-receiving sheet may be used as the above material to which a dye is transferred.

The above thermal transfer image-receiving sheet is not particularly limited as long as the recording face of the sheet has a dye-receiving property, and examples thereof include a sheet obtained by forming a dye-receiving layer on at least one surface of a base which is made from a paper, a metal, a glass, or a synthetic resin.

When the thermal transfer sheet is a thermofusible transfer sheet, a common paper, a plastic film or the like may also be used as a material to which a dye is transferred.

The printer used for thermal transfer is not particularly limited, and publicly known thermal transfer printers may be used.

EFFECT OF THE INVENTION

Since the thermal transfer sheet of the present invention has the above constitution, it hardly causes a problem that a dye, which has been transferred to the heat resistant slipping layer due to contact under a pressure during storage in a wound state after printing, is retransferred to a transfer protective layer or the like during a rewinding step until the sheet is brought into a product form and thereby printing precision is significantly impaired, and further it has a low friction force and excellent heat resistance.

BEST MODE FOR CARRYING OUT THE INVENTION

Hereinafter, the present invention will be described in more detail by way of Examples and Comparative Examples, but the present invention is not limited to these Examples and Comparative Examples.

In addition, the "part" and "%" in Examples means "part by weight" and "% by weight" unless specified otherwise.

Products used in the respective Examples and Comparative Examples are shown in Table 1. In this Table, "KT" represents a solution of methyl ethyl ketone [MEK]/toluene=1/1, "KTI" represents a solution of MEK/toluene/isopropyl alcohol=1/1/1, "K" represents MEK, and "TBK" represents methyl isobutyl ketone [MIBK].

TABLE 1

(a)

| | Component | Grade | Manufacturer | Note |
|---|---|---|---|---|
| Binder resin | CAB (cellulose acetate butyrate resin) | CAB-531-1 | Eastman Chemical Company | solid content 30% KT, butylation degree 50% |
| | | CAB-500-5 | Eastman Chemical Company | solid content 30% KT, butylation degree 51% |
| | | CAB-551-0.01 | Eastman Chemical Company | solid content 30% KT, butylation degree 53% |
| | | CAB-381-0.1 | Eastman Chemical Company | solid content 30% KT, butylation degree 38% |
| | | CAB-321-0.1 | Eastman Chemical Company | solid content 30% KT, butylation degree 32.5% |
| | | CAB-171-15S | Eastman Chemical Company | solid content 30% KT, butylation degree 17% |
| | CAP (cellulose acetate propionate resin) | CAP-482-0.5 | Eastman Chemical Company | solid content 30% KT |
| | Acrylic resin | DIANAL BR-83 | MITSUBISHI RAYON CO., Ltd. | solid content 30% KT |
| | Polyester resin | Vylon 200 | TOYOBO Co., Ltd. | solid content 30% KT |
| | Urethane resin | Nippollan 5199 | Nippon Polyurethane Industry Co., Ltd. | solid content 30% KTI |
| Curing agent | Isocyanate compound | CROSSNATE D-70 | Dainichiseika Color & Chemicals Mfg. Co., Ltd. | toluene diissocyanate (TDI), solid content 50% ethyl acetate |
| Lubricant (B) | Metallic soap (zinc stearate) | SZ-PF | Sakai Chemical Industry Co., Ltd. | powder |
| | Metallic soap (zinc stearyl phosphate) | LBT-1830 purified | Sakai Chemical Industry Co., Ltd. | powder |
| | Phosphate ester | PLYSURF M-208BM | DAI-ICHI KOGYO SEIYAKU Co., Ltd. | solid content 100% |
| | Silicone oil | KF965-100 | Shin-Etsu chemical Co., Ltd. | solid content 100% |
| | Silicone modified resin | Symac US-380 | TOAGOSEI Co., Ltd. | solid content 30% TBK |
| Filler | Talc | MICRO ACE P-3 | Nippon Talc Co., Ltd. | powder, average particle size 5.1 μm, Mohs' hardness 3 |
| | Silicone rubber powder | KMP-597 | Shin-Etsu chemical Co., Ltd. | powder, average particle size 13 μm |
| | Mica | MK-100 | CO-OP CHEMICAL Co., Ltd. | powder, average particle size 1.0 to 2.0 μm |

EXAMPLE 1

The following materials were mixed respectively in a mixed solvent of methyl ethyl ketone [MEK] and toluene in proportions of 1/1 (by weight) to contain a solid content of 10.5%, and the resulting mixture was stirred and dispersed in a paint shaker for 3 hours, to prepare an ink for a heat resistant slipping layer.

| (Ink for heat resistant slipping layer) | |
|---|---|
| CAB resin (A1) (CAB-551-0.01, butyryl group content 53%, solid content 30% by weight, manufactured by Eastman Chemical Company) | 100 parts |
| Lubricant (B) (zinc stearate, SZ-PF, manufactured by Sakai Chemical Industry Co., Ltd., 100% by weight powder) | 3 parts |
| MEK/toluene = 1/1 (by weight, the same shall apply hereinafter) | 211 parts |

The obtained ink for a heat resistant slipping layer was applied onto one surface of a polyester film (DIAFOIL K203E, 6.0 μm, manufactured by Mitsubishi Polyester Film, Inc.) so as to become a thickness of 0.5 g/m$^2$ based on weight in drying using a wire bar coater, and was subjected to drying treatment in an oven of 80° C. for 1 minute to form a heat resistant slipping layer, followed by preparing a heat resistant slipping layer-formed sheet (for evaluation of the dye transfer).

Furthermore, a coating liquid for a color material layer, having the following composition, was applied onto a surface opposite to the surface of the obtained sheet on which the heat resistant slipping layer was disposed in such a manner that a dried amount of application was 0.8 g/m$^2$ by gravure coating, and the applied coating liquid was dried to form a color material layer, followed by preparing the thermal transfer sheet (for evaluation of friction) of Example 1.

| (Composition of coating liquid for color material layer) | |
|---|---|
| C.I. solvent blue 63 | 3.0 parts |
| Polyvinyl butyral resin (S-LEC BX-1, manufactured by SEKISUI CHEMICAL Co., Ltd.) | 3.0 parts |
| MEK/toluene = 1/1 | 82.0 parts |

EXAMPLE 2

A heat resistant slipping layer-formed sheet and a thermal transfer sheet were prepared in the same manner as in Example 1 except for using materials of the following composition as an ink for a heat resistant slipping layer.

| (Ink for heat resistant slipping layer) | |
|---|---|
| CAB resin (A1) (CAB-551-0.01, butyryl group content 53%, solid content 30% by weight, manufactured by Eastman Chemical Company) | 100 parts |
| Lubricant (B) (zinc stearate, SZ-PF, 100% by weight powder, manufactured by Sakai Chemical Industry Co., Ltd.) | 3 parts |
| Filler (talc, MICRO ACE P-3, solid content 100% by weight powder, manufactured by Nippon Talc Co., Ltd.) | 3 parts |
| MEK/toluene = 1/1 | 237 parts |

EXAMPLES 3 TO 4

A heat resistant slipping layer-formed sheet and a thermal transfer sheet were prepared in the same manner as in Example 2 except that the CAB resin (A1) of the ink for a heat resistant slipping layer was changed to CAB-531-1 (butyryl group content 50%, solid content 30% by weight, manufactured by Eastman Chemical Company) in Example 3 and changed to CAB 500-5 (butyryl group content 51%, solid content 30% by weight, manufactured by Eastman Chemical Company) in Example 4.

EXAMPLES 5 TO 7

A heat resistant slipping layer-formed sheet and a thermal transfer sheet were prepared in the same manner as in Example 2 except that a type of the lubricant (B) of the ink for a heat resistant slipping layer was changed to LBT-1830 purified (zinc stearyl phosphate, solid content 100% by weight powder, manufactured by Sakai Chemical Industry Co., Ltd.) in Example 5, changed to PLYSURF M208BM (phosphate ester, solid content 100% by weight, manufactured by DAI-ICHI KOGYO SEIYAKU Co., Ltd.) in Example 6, and changed to KF965-100 (silicone oil, solid content 100% by weight, manufactured by Shin-Etsu chemical Co., Ltd.) in Example 7.

EXAMPLE 8

A heat resistant slipping layer-formed sheet and a thermal transfer sheet were prepared in the same manner as in Example 2 except that in the preparation of the ink for a heat resistant slipping layer, a type of the lubricant (B) was changed to 10 parts by weight of Symac US-380 (silicone modified resin, solid content 30% by weight, manufactured by TOAGOSEI Co., Ltd.) and an addition amount of the MEK/toluene solvent (in the proportions of 1/1 by weight, the same shall apply hereinafter) was changed to 230 parts.

EXAMPLES 9 TO 10

A heat resistant slipping layer-formed sheet and a thermal transfer sheet were prepared in the same manner as in Example 2 except that a type of the filler of the ink for a heat resistant slipping layer was changed to KMP-597 (silicone rubber filler, solid content 100% by weight powder, manufactured by Shin-Etsu chemical Co., Ltd.) in Example 9, and changed to MK-100 (mica, solid content 100% by weight powder, manufactured by CO-OP CHEMICAL Co., Ltd.) in Example 10.

EXAMPLE 11

A heat resistant slipping layer-formed sheet and a thermal transfer sheet were prepared in the same manner as in Example 1 except for using materials of the following composition as an ink for a heat resistant slipping layer.

| (Ink for heat resistant slipping layer) | |
|---|---|
| CAB resin (A1) (CAB-551-0.01, butyryl group content 53%, solid content 30% by weight, manufactured by Eastman Chemical Company) | 100 parts |
| Isocyanate compound (CROSSNATE D-70, solid content 50% by weight; manufactured by Dainichiseika Color & Chemicals Mfg. Co., Ltd.) | 6.0 parts |
| Lubricant (B) (zinc stearate, SZ-PF, 100% by weight powder, manufactured by Sakai Chemical Industry Co., Ltd.) | 3 parts |
| Filler (talc, MICRO ACE P-3, solid content 100% by weight powder, manufactured by Nippon Talc Co., Ltd.) | 3 parts |
| MEK/toluene = 1/1 | 260 parts |

EXAMPLES 12 TO 16

A heat resistant slipping layer-formed sheet and a thermal transfer sheet were prepared in the same manner as in Example 2 except that in the preparation of the ink for a heat resistant slipping layer, as a binder resin, 70 parts of a CAB resin (A1) (CAB-551-0.01, butyryl group content 53%, solid content 30% by weight, manufactured by Eastman Chemical Company) and 30 parts of CAB-381-0.1 (butyryl group content 38%, solid content 30% by weight, manufactured by Eastman Chemical Company) were added in Example 12, 70 parts of the above CAB resin (A1) and 30 parts of CAP-482-0.5 (solid content 30% by weight, manufactured by Eastman Chemical Company) were added in Example 13, 70 parts of the above CAB resin (A1) and 30 parts of DIANAL BR-83 (acrylic resin, solid content 30% by weight, manufactured by MITSUBISHI RAYON Co., Ltd.) were added in Example 14, 70 parts of the above CAB resin (A1) and 30 parts of Vylon 200 (polyester resin, solid content 30% by weight, manufactured by TOYOBO Co., Ltd.) were added in Example 15, and 70 parts of the above CAB resin (A1) and 30 parts of Nippollan 5199 (urethane resin, solid content 30% by weight, manufactured by Nippon Polyurethane Industry Co., Ltd.) were added in Example 16.

EXAMPLE 17

A heat resistant slipping layer-formed sheet and a thermal transfer sheet were prepared in the same manner as in Example 2 except that in the preparation of the ink for a heat resistant slipping layer, a type and an addition amount of the lubricant (B) and an addition amount of the MEK/toluene solvent were changed to the following conditions.

| | |
|---|---|
| Lubricant (B) (zinc stearate, SZ-PF, solid content 100% by weight powder, manufactured by Sakai Chemical Industry Co., Ltd.) | 1.5 parts |
| Lubricant (B) (silicone modified resin, Symac US-380, solid content 30% by weight, manufactured by TOAGOSEI Co., Ltd.) | 5.0 parts |
| MEK/toluene = 1/1 | 233 parts |

EXAMPLE 18

A heat resistant slipping layer-formed sheet and a thermal transfer sheet were prepared in the same manner as in Example 2 except that in the preparation of the ink for a heat resistant slipping layer, a type and an addition amount of the lubricant (B) and an addition amount of the MEK/toluene solvent were changed to the following conditions.

| | |
|---|---|
| Lubricant (B) (zinc stearate, SZ-PF, solid content 100% by weight powder, manufactured by Sakai Chemical Industry Co., Ltd.) | 1.0 part |
| Lubricant (B) (silicone modified resin, Symac US-380, solid content 30% by weight, manufactured by TOAGOSEI Co., Ltd.) | 3.3 parts |
| Lubricant (B) (phosphate ester, PLYSURF M208BM, solid content 100% by weight, manufactured by DAI-ICHI KOGYO SEIYAKU Co., Ltd.) | 1.0 part |
| MEK/toluene = 1/1 | 234 parts |

EXAMPLE 19

A heat resistant slipping layer-formed sheet and a thermal transfer sheet were prepared in the same manner as in Example 2 except that in the preparation of the ink for a heat resistant slipping layer, a type and an addition amount of the lubricant (B) and an addition amount of the MEK/toluene solvent were changed to the following conditions.

| | |
|---|---|
| Lubricant (B) (zinc stearate, SZ-PF, solid content 100% by weight powder, manufactured by Sakai Chemical Industry Co., Ltd.) | 1.0 part |
| Lubricant (B) (silicone modified resin, Symac US-380, solid content 30% by weight, manufactured by TOAGOSEI Co., Ltd.) | 3.3 parts |
| Lubricant (B) (silicone oil, KF965-100, solid content 100% by weight, manufactured by Shin-Etsu chemical Co., Ltd.) | 1.0 part |
| MEK/toluene = 1/1 | 234 parts |

COMPARATIVE EXAMPLES 1 TO 3

A heat resistant slipping layer-formed sheet and a thermal transfer sheet were prepared in the same manner as in Example 2 except that as the CAB resin (A1) of the ink for a heat resistant slipping layer, CAB-171-15S (butyryl group content 17%, solid content 30% by weight, manufactured by Eastman Chemical Company) is used in Comparative Example 1, CAB-321-0.1 (butyryl group content 32.5%, solid content 30% by weight, manufactured by Eastman Chemical Company) is used in Comparative Example 2, and CAB-381-0.1 (butyryl group content 38%, solid content 30% by weight, manufactured by Eastman Chemical Company) is used in Comparative Example 3.

COMPARATIVE EXAMPLE 4

A heat resistant slipping layer-formed sheet and a thermal transfer sheet were prepared in the same manner as in Example 2 except that in the preparation of the ink for a heat resistant slipping layer, the lubricant (B) was not added and an addition amount of the MEK/toluene solvent was changed to 211 parts by weight.

COMPARATIVE EXAMPLE 5

A heat resistant slipping layer-formed sheet and a thermal transfer sheet were prepared in the same manner as in Example 2 except that in the preparation of the ink for a heat resistant slipping layer, an addition amount of the lubricant (B) was changed to 12 parts by weight and an addition amount of the MEK/toluene solvent was changed to 314 parts by weight.

COMPARATIVE EXAMPLE 6

A heat resistant slipping layer-formed sheet and a thermal transfer sheet were prepared in the same manner as in Example 2 except that in the preparation of the ink for a heat resistant slipping layer, a type of the lubricant (B) was changed to Symac US-380 (addition amount 40 parts by weight) and an addition amount of the MEK/toluene solvent was changed to 286 parts by weight.

COMPARATIVE EXAMPLES 7 TO 8

A heat resistant slipping layer-formed sheet and a thermal transfer sheet were prepared in the same manner as in Example 2 except for using 40 parts by weight of KF965-100 (silicone oil, solid content 100% by weight, manufactured by Shin-Etsu chemical Co., Ltd.) in Comparative Example 7 and using 12 parts by weight of PLYSURF M208BM (phosphate ester, solid content 100% by weight, manufactured by DAI-ICHI KOGYO SEIYAKU Co., Ltd.) in Comparative Example 8 as a lubricant (B) of the ink for a heat resistant slipping layer.

COMPARATIVE EXAMPLE 9

A heat resistant slipping layer-formed sheet and a thermal transfer sheet were prepared in the same manner as in Example 11 except that in the preparation of the ink for a heat resistant slipping layer, a type of the CAB resin (A1) was changed to CAB-381-0.1, an addition amount of the isocyanate compound was set to 12 parts by weight and an addition amount of the MEK/toluene solvent was changed to 282 parts by weight.

COMPARATIVE EXAMPLE 10

A heat resistant slipping layer-formed sheet and a thermal transfer sheet were prepared in the same manner as in Comparative Example 9 except that in the preparation of the ink for a heat resistant slipping layer, an addition amount of the isocyanate compound was changed to 18 parts by weight and an addition amount of the MEK/toluene solvent was changed to 305 parts by weight.

COMPARATIVE EXAMPLE 11

A heat resistant slipping layer-formed sheet and a thermal transfer sheet were prepared in the same manner as in Example 2 except that in the preparation of the ink for a heat resistant slipping layer, addition amounts of the lubricant (B) and the filler were respectively changed to 9 parts by weight and further an addition amount of the MEK/toluene solvent was changed to 339 parts by weight.

COMPARATIVE EXAMPLE 12

A heat resistant slipping layer-formed sheet and a thermal transfer sheet were prepared in the same manner as in Example 1 except for using materials of the following composition as an ink for a heat resistant slipping layer.

| (Ink for heat resistant slipping layer) | |
|---|---|
| CAB resin (A1) (CAB-551-0.01, butyryl group content 53%, solid content 30% by weight, manufactured by Eastman Chemical Company) | 45 parts |
| Cellulose acetate butyrate resin (CAB-381-0.1, butyryl group content 38%, solid content 30% by weight, manufactured by Eastman Chemical Company) | 55 parts |
| Isocyanate compound (CROSSNATE D-70, solid content 50% by weight; manufactured by Dainichiseika Color & Chemicals Mfg. Co., Ltd.) | 6 parts |
| Lubricant (B) (zinc stearate, SZ-PF, 100% by weight powder, manufactured by Sakai Chemical Industry Co., Ltd.) | 3 parts |
| Filler (talc, MICRO ACE P-3, solid content 100% by weight powder, manufactured by Nippon Talc Co., Ltd.) | 3 parts |
| MEK/toluene = 1/1 | 259 parts |

COMPARATIVE EXAMPLE 13

A heat resistant slipping layer-formed sheet and a thermal transfer sheet were prepared in the same manner as in Example 1 except for using materials of the following composition as an ink for a heat resistant slipping layer.

| (Ink for heat resistant slipping layer) | |
|---|---|
| CAB resin (A1) (CAB-551-0.01, butyryl group content 53%, solid content 30% by weight, manufactured by Eastman Chemical Company) | 100 parts |
| Isocyanate compound (CROSSNATE D-70, solid content 50% by weight; manufactured by Dainichiseika Color & Chemicals Mfg. Co., Ltd.) | 18 parts |
| Lubricant (B) (zinc stearate, SZ-PF, 100% by weight powder, manufactured by Sakai Chemical Industry Co., Ltd.) | 4.5 parts |
| Lubricant (B) (silicone modified resin, Symac US-380, solid content 30% by weight, manufactured by TOAGOSEI Co., Ltd.) | 20 parts |
| Filler (talc, MICRO ACE P-3, solid content 100% by weight powder, manufactured by Nippon Talc Co., Ltd.) | 3 parts |
| MEK/toluene = 1/1 | 354 parts |

The following characteristics were evaluated on the heat resistant slipping layer-formed sheets and the thermal transfer sheets obtained in the respective Examples and Comparative Examples.

1. Friction

Using a thermal head KST-105-13FAN manufactured by KYOCERA Corporation, solid images (gray-scale value 255/255: maximum density) and white portions (gray-scale value 0/255) were printed at a printing pressure of 30 N under the conditions of 4 kgW load and printing energy of 0.11 W/dot and a dynamical friction force of the thermal head with the heat resistant slipping layer was measured. Friction coefficient was determined by dividing the dynamical friction force by the printing pressure.

As an image-receiving paper, a color ink/paper set KP-36IP (trade name) manufactured by Canon Inc. was used and the width of the image-receiving paper was set at 7 cm.

(Evaluation Criteria)

A ratio ($\mu255/\mu0$) of friction coefficient ($\mu255$) at a solid image portion to friction coefficient ($\mu0$) at the time of white-printing was evaluated according to the following criteria.

Good: $0.7 \leqq \mu255/\mu0 \leqq 1.2$

Poor: $\mu255/\mu0 > 1.2$ or $\mu255/\mu0 < 0.7$

Average: Friction coefficient lies within the range of a symbol Good but a foreign matter is deposited on a thermal head 2. Dye Retransfer; The Following Procedures (1) to (3) were Performed in Order to Measure the Dye Retransfer.

(1) Dye transfer from color material layer to heat resistant slipping Layer

The surface of a color material layer and the surface of a heat resistant slipping layer of a heat resistant slipping layer-formed sheet, which were cut into a piece having a size of 5 cm×5 cm, were overlaid on each other, and a load of 20 kgw/cm$^2$ was applied to this piece to forcibly transfer a dye under the circumstances of 40° C., humidity 20% using a constant force compression tester (manufactured by Toyo Seiki Seisaku-sho, Ltd.) (transfer time: 96 hours).

As the color material layer, a magenta portion of a color ink/paper set KP-36IP (trade name) manufactured by Canon Inc. was used.

(2) Dye Retransfer from heat resistant slipping layer to protective layer

The surface of a heat resistant slipping layer to which a dye was transferred and the surface of a protective layer, which were cut into a piece having a size of 5 cm×5 cm, were overlaid on each other, and a load of 20 kgw/cm$^2$ was applied to this piece to forcibly retransfer the dye under the circumstances of 60° C., humidity 20% using a constant force compression tester (manufactured by Toyo Seiki Seisaku-sho, Ltd.) (transfer time: 24 hours).

As the protective layer, a protective layer portion of a color ink/paper set KP-36IP (trade name) manufactured by Canon Inc. was used.

(3) The surface of protective layer on which the dye is retransferred is overlaid on an image-receiving surface of an image-receiving paper and images were transferred at 4 mm·sec/line at 105° C. using a laminate testing machine (Lamipacker LPD2305PRO, manufactured by FUJIPLA Inc.).

Furthermore, the protective layer was removed from the image-receiving paper, and color hue of a transfer portion was measured according to the condition (a) of JIS Z 8722 using GRETAG Spectrolino (D65 light source, viewing angle 2°; manufactured by GRETAG Macbeth AG).

As the image-receiving paper, a color ink/paper set KP-36IP (trade name) manufactured by Canon Inc. was used.

(Evaluation Criteria)

Good: A color difference $\Delta E^*ab$ between transferred matters on the protective layer before and after a dye was retransferred is less than 2.5

Poor: A color difference $\Delta E^*ab$ between transferred matters on the protective layer before and after a dye was retransferred is 2.5 or more The value of color difference was determined from the following equation.

$$\Delta E^*ab = [(\text{difference in } L \text{ values between transferred matters on the protective layer before and after a dye is retransferred})^2 + (\text{difference in } a \text{ values between transferred matters on the protective layer before and after a dye is retransferred})^2 + (\text{difference in } b \text{ values between transferred matters on the protective layer before and after a dye is retransferred})^2]^{1/2}$$

In the above equations, the L value represents lightness, the a value represents chromaticity of a red-green axis, and the b value represents chromaticity of a yellow-blue axis.

Furthermore, the stability of the coating liquid for a heat resistant slipping layer prepared in Examples and Comparative Examples was evaluated.

3. Stability of Coating Liquid for Heat Resistant Slipping Layer 50 ml of the coating liquid right after preparation and a stirrer were put in a 110 ml glass container and the coating liquid was left standing for three hours and for six hours under the circumstances of 25° C., humidity 50% while stirring the coating liquid with a magnetic stirrer, and then a state (appearance, viscosity) of the coating liquid was visually observed.

(Evaluation Criteria)

Good: The states of the coating liquid after a lapse of three hours and six hours do not differ from that of the coating liquid right after preparation.

Poor: The states of the coating liquid after a lapse of three hours and six hours differ from that of the coating liquid right after preparation.

The results of the tests are shown in the following Table 2.

TABLE 2

| | Binder resin | | | | | | | |
|---|---|---|---|---|---|---|---|---|
| | Binder resin (A) | Weight (part) | Resin other than binder resin (A) | Weight (part) | Isocyanate compound | Weight (part) | Lubricant (B) | Weight (part) |
| Example 1 | CAB-551-0.01 | 100.0 | — | 0.0 | — | 0.0 | SZ-PF | 3.0 |
| Example 2 | CAB-551-0.01 | 100.0 | — | 0.0 | — | 0.0 | SZ-PF | 3.0 |
| Example 3 | CAB-531-1 | 100.0 | — | 0.0 | — | 0.0 | SZ-PF | 3.0 |
| Example 4 | CAB-500-5 | 100.0 | — | 0.0 | — | 0.0 | SZ-PF | 3.0 |
| Example 5 | CAB-551-0.01 | 100.0 | — | 0.0 | — | 0.0 | LBT-1830 purified | 3.0 |
| Example 6 | CAB-551-0.01 | 100.0 | — | 0.0 | — | 0.0 | PLYSURF M208BM | 3.0 |
| Example 7 | CAB-551-0.01 | 100.0 | — | 0.0 | — | 0.0 | KF965-100 | 3.0 |
| Example 8 | CAB-551-0.01 | 100.0 | — | 0.0 | — | 0.0 | Symac US-380 | 10.0 |
| Example 9 | CAB-551-0.01 | 100.0 | — | 0.0 | — | 0.0 | SZ-PF | 3.0 |
| Example 10 | CAB-551-0.01 | 100.0 | — | 0.0 | — | 0.0 | SZ-PF | 3.0 |
| Example 11 | CAB-551-0.01 | 100.0 | — | 0.0 | CROSSNATE D-70 | 6.0 | SZ-PF | 3.0 |
| Example 12 | CAB-551-0.01 | 70.0 | CAB-381-0.1 | 30.0 | — | 0.0 | SZ-PF | 3.0 |
| Example 13 | CAB-551-0.01 | 70.0 | CAP482-0.5 | 30.0 | — | 0.0 | SZ-PF | 3.0 |
| Example 14 | CAB-551-0.01 | 70.0 | DIANAL BR-83 | 30.0 | — | 0.0 | SZ-PF | 3.0 |
| Example 15 | CAB-551-0.01 | 70.0 | Vylon 200 | 30.0 | — | 0.0 | SZ-PF | 3.0 |
| Example 16 | CAB-551-0.01 | 70.0 | Nippollan 5199 | 30.0 | — | 0.0 | SZ-PF | 3.0 |
| Example 17 | CAB-551-0.01 | 100.0 | — | 0.0 | — | 0.0 | SZ-PF(100% w.t.) | 1.5 |
| | | | | | | | Symac US-380 (30% w.t.) | 5.0 |
| Example 18 | CAB-551-0.01 | 100.0 | — | 0.0 | — | 0.0 | SZ-PF(100% w.t.) | 1.0 |
| | | | | | | | Symac US-380 (30% w.t.) | 3.3 |
| | | | | | | | PLYSURF M208BM (100% w.t.) | 1.0 |
| Example 19 | CAB-551-0.01 | 100.0 | — | 0.0 | — | 0.0 | SZ-PF(100% w.t.) | 1.0 |
| | | | | | | | Symac US-380 (30% w.t.) | 3.3 |
| | | | | | | | KF965-100 (100% w.t.) | 1.0 |

| | Filler | Weight (part) | Solvent MEK/Tol = 1/1 | Dye transfer from heat resistant slipping layer to protective layer | Friction | Ink stability |
|---|---|---|---|---|---|---|
| Example 1 | — | 0.0 | 211 | Good | Good | Good |
| Example 2 | MICROACE P-3 | 3.0 | 237 | Good | Good | Good |
| Example 3 | MICROACE P-3 | 3.0 | 237 | Good | Good | Good |
| Example 4 | MICROACE P-3 | 3.0 | 237 | Good | Good | Good |
| Example 5 | MICROACE P-3 | 3.0 | 237 | Good | Good | Good |
| Example 6 | MICROACE P-3 | 3.0 | 237 | Good | Good | Good |
| Example 7 | MICROACE P-3 | 3.0 | 237 | Good | Good | Good |
| Example 8 | MICROACE P-3 | 3.0 | 230 | Good | Good | Good |
| Example 9 | KMP-597 | 3.0 | 237 | Good | Good | Good |
| Example 10 | MK-100 | 3.0 | 237 | Good | Good | Good |
| Example 11 | MICROACE P-3 | 3.0 | 260 | Good | Good | Good |
| Example 12 | MICROACE P-3 | 3.0 | 237 | Good | Good | Good |
| Example 13 | MICROACE P-3 | 3.0 | 237 | Good | Good | Good |
| Example 14 | MICROACE P-3 | 3.0 | 237 | Good | Good | Good |
| Example 15 | MICROACE P-3 | 3.0 | 237 | Good | Good | Good |
| Example 16 | MICROACE P-3 | 3.0 | 237 | Good | Good | Good |
| Example 17 | MICROACE P-3 | 3.0 | 233 | Good | Good | Good |
| Example 18 | MICROACE P-3 | 3.0 | 234 | Good | Good | Good |
| Example 19 | MICROACE P-3 | 3.0 | 234 | Good | Good | Good |

TABLE 2-continued

| | Binder resin | | | | | | | |
|---|---|---|---|---|---|---|---|---|
| | Binder resin (A) | Weight (part) | Resin other than binder resin (A) | Weight (part) | Isocyanate compound | Weight (part) | Lubricant (B) | Weight (part) |
| Comparative Example 1 | CAB-171-15S | 100.0 | — | 0.0 | — | 0.0 | SZ-PF | 3.0 |
| Comparative Example 2 | CAB-321-0.1 | 100.0 | — | 0.0 | — | 0.0 | SZ-PF | 3.0 |
| Comparative Example 3 | CAB-381-0.1 | 100.0 | — | 0.0 | — | 0.0 | SZ-PF | 3.0 |
| Comparative Example 4 | CAB-551-0.01 | 100.0 | — | 0.0 | — | 0.0 | — | 0.0 |
| Comparative Example 5 | CAB-551-0.01 | 100.0 | — | 0.0 | — | 0.0 | SZ-PF | 12.0 |
| Comparative Example 6 | CAB-551-0.01 | 100.0 | — | 0.0 | — | 0.0 | Symac US-380 | 40.0 |
| Comparative Example 7 | CAB-551-0.01 | 100.0 | — | 0.0 | — | 0.0 | KF965-100 | 12.0 |
| Comparative Example 8 | CAB-551-0.01 | 100.0 | — | 0.0 | — | 0.0 | PLYSURF M208BM | 12.0 |
| Comparative Example 9 | CAB-381-0.1 | 100.0 | — | 0.0 | CROSSNATE D-70 | 12.0 | SZ-PF | 3.0 |
| Comparative Example 10 | CAB-381-0.1 | 100.0 | — | 0.0 | CROSSNATE D-70 | 18.0 | SZ-PF | 3.0 |
| Comparative Example 11 | CAB-551-0.01 | 100.0 | — | 0.0 | — | 0.0 | SZ-PF | 9.0 |
| Comparative Example 12 | CAB-551-0.01 | 45.0 | CAB-381-0.1 | 55.0 | CROSSNATE D-70 | 6.0 | SZ-PF | 3.0 |
| Comparative Example 13 | CAB-551-0.01 | 100.0 | — | 0.0 | CROSSNATE D-70 | 18.0 | SZ-PF(100% w.t.)<br>Symac US-380 (30% w.t.) | 4.5<br>20.0 |

| | Filler | Weight (part) | Solvent MEK/Tol = 1/1 | Dye transfer from heat resistant slipping layer to protective layer | Friction | Ink stability |
|---|---|---|---|---|---|---|
| Comparative Example 1 | MICRO ACE P-3 | 3.0 | 237 | Poor | Good | Good |
| Comparative Example 2 | MICRO ACE P-3 | 3.0 | 237 | Poor | Good | Good |
| Comparative Example 3 | MICRO ACE P-3 | 3.0 | 237 | Poor | Good | Good |
| Comparative Example 4 | MICRO ACE P-3 | 3.0 | 211 | Good | Poor | Good |
| Comparative Example 5 | MICRO ACE P-3 | 3.0 | 314 | Good | Average | Good |
| Comparative Example 6 | MICRO ACE P-3 | 3.0 | 286 | Poor | Good | Good |
| Comparative Example 7 | MICRO ACE P-3 | 3.0 | 314 | Poor | Good | Good |
| Comparative Example 8 | MICRO ACE P-3 | 3.0 | 314 | Poor | Good | Good |
| Comparative Example 9 | MICRO ACE P-3 | 3.0 | 282 | Poor | Good | Good |
| Comparative Example 10 | MICRO ACE P-3 | 3.0 | 305 | Good | Good | Poor |
| Comparative Example 11 | MICRO ACE P-3 | 9.0 | 339 | Poor | Good | Good |
| Comparative Example 12 | MICRO ACE P-3 | 3.0 | 259 | Poor | Good | Good |
| Comparative Example 13 | MICRO ACE P-3 | 3.0 | 354 | Poor | Good | Good |

The heat resistant slipping layer-formed sheets and the thermal transfer sheets of Examples had respectively low degree of dye transfer and low friction coefficient. On the other hand, those of Comparative Examples 1 to 3 and 9, in which only cellulose acetate butyrate resins having a butyryl group content of less than 50% were used, had high degree of dye transfer.

EXAMPLE 20

A polyethylene terephthalate film [PET] (manufactured by Mitsubishi Polyester Film, Inc., DIAFOIL K203E) having a thickness of 6 μm, which had been subjected to easy adhesion treatment, was used as a base film, and a coating liquid A for a heat resistant slipping layer, having the following composition, was applied onto one surface of the polyethylene terephthalate film in such a manner that a dried amount of application was 0.5 g/m$^2$ by gravure coating, and the applied coating liquid was dried at 110° C. for 2 minutes to form a heat resistant slipping layer, followed by preparing a heat resistant slipping layer-formed sheet of Example 20.

| <Coating liquid A for heat resistant slipping layer> | |
|---|---|
| CAB resin (CAB 551-0.01, solid content 100% by weight, manufactured by Eastman Chemical Company) | 75.0 parts |
| Acrylic resin (DIANAL BR-83, solid content 100% by weight, manufactured by MITSUBISHI RAYON Co., Ltd.) | 25.0 parts |
| Zinc stearyl phosphate (SZ-PF, solid content 100% by weight, manufactured by Sakai Chemical Industry Co., Ltd.) | 5.0 parts |
| Talc (MICRO ACE P-3, solid content 100% by weight; manufactured by Nippon Talc Co., Ltd.) | 5.0 parts |
| Methyl ethyl ketone | 469.0 parts |
| Toluene | 469.0 parts |

EXAMPLE 21

A heat resistant slipping layer-formed sheet of Example 21 was prepared in the same manner as in Example 20 except that the coating liquid A for a heat resistant slipping layer was changed to a coating liquid B for a heat resistant slipping layer having the following composition to form a heat resistant slipping layer.

| <Coating liquid B for heat resistant slipping layer> | |
|---|---|
| CAB resin (CAB 551-0.01, solid content 100% by weight, manufactured by Eastman Chemical Company) | 75.0 parts |
| Acrylic resin (DIANAL BR-83, solid content 100% by weight, manufactured by MITSUBISHI RAYON Co., Ltd.) | 25.0 parts |
| Silicone modified acrylic resin (Symac US-380, solid content 30% by weight, manufactured by TOAGOSEI Co., Ltd.) | 16.7 parts |
| Talc (MICRO ACE P-3, solid content 100% by weight; manufactured by Nippon Talc Co., Ltd.) | 5.0 parts |
| Methyl ethyl ketone | 463.0 parts |
| Toluene | 463.0 parts |

EXAMPLE 22

A heat resistant slipping layer-formed sheet of Example 22 was prepared in the same manner as in Example 20 except that the coating liquid A for a heat resistant slipping layer was changed to a coating liquid C for a heat resistant slipping layer having the following composition to form a heat resistant slipping layer.

| <Coating liquid C for heat resistant slipping layer> | |
|---|---|
| CAB resin (CAB 551-0.01, solid content 100% by weight, manufactured by Eastman Chemical Company) | 75.0 parts |
| Acrylic resin (DIANAL BR-83, solid content 100%, manufactured by MITSUBISHI RAYON Co., Ltd.) | 25.0 parts |
| Zinc stearyl phosphate (SZ-PF, solid content 100% by weight; manufactured by Sakai Chemical Industry Co., Ltd.) | 5.0 parts |
| Silicone modified acrylic resin (Symac US-380, solid content 30% by weight, manufactured by TOAGOSEI Co., Ltd.) | 16.7 parts |
| Talc (MICRO ACE P-3, solid content 100% by weight; manufactured by Nippon Talc Co., Ltd.) | 5.0 parts |
| Methyl ethyl ketone | 484.5 parts |
| Toluene | 484.5 parts |

EXAMPLE 23

A heat resistant slipping layer-formed sheet of Example 23 was prepared in the same manner as in Example 20 except that the coating liquid A for a heat resistant slipping layer was changed to a coating liquid D for a heat resistant slipping layer having the following composition to form a heat resistant slipping layer.

| <Coating liquid D for heat resistant slipping layer> | |
|---|---|
| CAB resin (CAB 551-0.01, solid content 100% by weight, manufactured by Eastman Chemical Company) | 75.0 parts |
| Acrylic resin (DIANAL BR-83, solid content 100% by weight, manufactured by MITSUBISHI RAYON Co., Ltd.) | 25.0 parts |
| Zinc stearyl phosphate (SZ-PF, solid content 100% by weight; manufactured by Sakai Chemical Industry Co., Ltd.) | 5.0 parts |
| Silicone modified acrylic resin (Modiper FS-720, solid content 15% by weight, manufactured by NOF Corporation) | 33.3 parts |
| Talc (MICRO ACE P-3, solid content 100% by weight; manufactured by Nippon Talc Co., Ltd.) | 5.0 parts |
| Methyl ethyl ketone | 476.0 parts |
| Toluene | 476.0 parts |

EXAMPLE 24

A heat resistant slipping layer-formed sheet of Example 24 was prepared in the same manner as in Example 20 except that the coating liquid A for a heat resistant slipping layer was changed to a coating liquid E for a heat resistant slipping layer having the following composition to form a heat resistant slipping layer.

| <Coating liquid E for heat resistant slipping layer> | |
|---|---|
| CAB resin (CAB 551-0.01, solid content 100% by weight, manufactured by Eastman Chemical Company) | 75.0 parts |
| Acrylic resin (DIANAL BR-83, solid content 100% by weight, manufactured by MITSUBISHI RAYON Co., Ltd.) | 25.0 parts |

-continued

| <Coating liquid E for heat resistant slipping layer> | |
|---|---|
| Zinc stearyl phosphate (SZ-PF, solid content 100% by weight; manufactured by Sakai Chemical Industry Co., Ltd.) | 5.0 parts |
| Silicone modified urethane resin (DAIAROMER SP-2105, solid content 20% by weight; manufactured by Dainichiseika Color & Chemicals Mfg. Co., Ltd.) | 25.0 parts |
| Talc (MICRO ACE P-3, solid content 100% by weight; manufactured by Nippon Talc Co., Ltd.) | 5.0 parts |
| Methyl ethyl ketone | 480.0 parts |
| Toluene | 480.0 parts |

EXAMPLE 25

A heat resistant slipping layer-formed sheet of Example 25 was prepared in the same manner as in Example 20 except that the coating liquid A for a heat resistant slipping layer was changed to a coating liquid F for a heat resistant slipping layer having the following composition to form a heat resistant slipping layer.

| <Coating liquid F for heat resistant slipping layer> | |
|---|---|
| CAB resin (CAB 551-0.01, solid content 100% by weight, manufactured by Eastman Chemical Company) | 75.0 parts |
| Acrylic resin (DIANAL BR-83, solid content 100% by weight, manufactured by MITSUBISHI RAYON Co., Ltd.) | 25.0 parts |
| Zinc stearyl phosphate (SZ-PF, solid content 100% by weight; manufactured by Sakai Chemical Industry Co., Ltd.) | 5.0 parts |
| Silicone modified ester resin (X-24-8300, solid content 25% by weight; manufactured by Shin-Etsu chemical Co., Ltd.) | 20.0 parts |
| Talc (MICRO ACE P-3, solid content 100% by weight; manufactured by Nippon Talc Co., Ltd.) | 5.0 parts |
| Methyl ethyl ketone | 482.5 parts |
| Toluene | 482.5 parts |

EXAMPLE 26

A heat resistant slipping layer-formed sheet of Example 26 was prepared in the same manner as in Example 20 except that the coating liquid A for a heat resistant slipping layer was changed to a coating liquid G for a heat resistant slipping layer having the following composition to form a heat resistant slipping layer.

| <Coating liquid G for heat resistant slipping layer> | |
|---|---|
| CAB resin (CAB 551-0.01, solid content 100% by weight, manufactured by Eastman Chemical Company) | 75.0 parts |
| Acrylic resin (DIANAL BR-83, solid content 100% by weight, manufactured by MITSUBISHI RAYON Co., Ltd.) | 25.0 parts |
| Zinc stearyl phosphate (SZ-PF, solid content 100% by weight; manufactured by Sakai Chemical Industry Co., Ltd.) | 5.0 parts |
| Silicone oil (KF965-100, solid content 100% by weight; manufactured by Shin-Etsu chemical Co., Ltd.) | 3.0 parts |
| Talc (MICRO ACE P-3, solid content 100% by weight; manufactured by Nippon Talc Co., Ltd.) | 5.0 parts |
| Methyl ethyl ketone | 481.5 parts |
| Toluene | 481.5 parts |

EXAMPLE 27

A heat resistant slipping layer-formed sheet of Example 27 was prepared in the same manner as in Example 20 except that the coating liquid A for a heat resistant slipping layer was changed to a coating liquid H for a heat resistant slipping layer having the following composition to form a heat resistant slipping layer.

| <Coating liquid H for heat resistant slipping layer> | |
|---|---|
| CAB resin (CAB 551-0.01, solid content 100% by weight, manufactured by Eastman Chemical Company) | 75.0 parts |
| Acrylic resin (DIANAL BR-83, solid content 100% by weight, manufactured by MITSUBISHI RAYON Co., Ltd.) | 25.0 parts |
| Zinc stearyl phosphate (SZ-PF, solid content 100% by weight; manufactured by Sakai Chemical Industry Co., Ltd.) | 5.0 parts |
| Silicone oil (X-22-173DX, solid content 100% by weight; manufactured by Shin-Etsu chemical Co., Ltd.) | 3.0 parts |
| Talc (MICRO ACE P-3, solid content 100% by weight; manufactured by Nippon Talc Co., Ltd.) | 5.0 parts |
| Methyl ethyl ketone | 481.5 parts |
| Toluene | 481.5 parts |

EXAMPLE 28

A heat resistant slipping layer-formed sheet of Example 28 was prepared in the same manner as in Example 20 except that the coating liquid A for a heat resistant slipping layer was changed to a coating liquid I for a heat resistant slipping layer having the following composition to form a heat resistant slipping layer.

| <Coatinq liquid I for heat resistant slipping layer> | |
|---|---|
| CAB resin (CAB 551-0.01, solid content 100% by weight, manufactured by Eastman Chemical Company) | 75.0 parts |
| Acrylic resin (DIANAL BR-83, solid content 100% by weight, manufactured by MITSUBISHI RAYON Co., Ltd.) | 25.0 parts |
| Zinc stearyl phosphate (SZ-PF, solid content 100% by weight; manufactured by Sakai Chemical Industry Co., Ltd.) | 5.0 parts |
| Phosphate ester (PLYSURF A-208N, solid content 100% by weight; manufactured by DAI-ICHI KOGYO SEIYAKU Co., Ltd.) | 3.0 parts |
| Talc (MICRO ACE P-3, solid content 100% by weight; manufactured by Nippon Talc Co., Ltd.) | 5.0 parts |
| Methyl ethyl ketone | 481.5 parts |
| Toluene | 481.5 parts |

EXAMPLE 29

A heat resistant slipping layer-formed sheet of Example 29 was prepared in the same manner as in Example 20 except that the coating liquid A for a heat resistant slipping layer was changed to a coating liquid J for a heat resistant slipping layer having the following composition to form a heat resistant slipping layer.

| <Coating liquid J for heat resistant slipping layer> | |
|---|---|
| CAB resin (CAB 551-0.01, solid content 100% by weight, manufactured by Eastman Chemical Company) | 75.0 parts |
| Acrylic resin (DIANAL BR-83, solid content 100% by weight, manufactured by MITSUBISHI RAYON Co., Ltd.) | 25.0 parts |
| Silicone modified acrylic resin (Symac US-380, solid content 30% by weight, manufactured by TOAGOSEI Co., Ltd.) | 16.7 parts |
| Phosphate ester (PLYSURF A-208N, solid content 100% by weight; manufactured by DAI-ICHI KOGYO SEIYAKU Co., Ltd.) | 3.0 parts |
| Talc (MICRO ACE P-3, solid content 100% by weight; manufactured by Nippon Talc Co., Ltd.) | 5.0 parts |
| Methyl ethyl ketone | 476.0 parts |
| Toluene | 476.0 parts |

EXAMPLE 30

A heat resistant slipping layer-formed sheet of Example 30 was prepared in the same manner as in Example 20 except that the coating liquid A for a heat resistant slipping layer was changed to a coating liquid K for a heat resistant slipping layer having the following composition to form a heat resistant slipping layer.

| <Coating liquid K for heat resistant slipping layer> | |
|---|---|
| CAB resin (CAB 551-0.01, solid content 100% by weight, manufactured by Eastman Chemical Company) | 75.0 parts |
| Acrylic resin (DIANAL BR-83, solid content 100% by weight, manufactured by MITSUBISHI RAYON Co., Ltd.) | 25.0 parts |
| Zinc stearyl phosphate (SZ-PF, solid content 100% by weight; manufactured by Sakai Chemical Industry Co., Ltd.) | 4.0 parts |
| Silicone modified acrylic resin (Symac US-380, solid content 30% by weight, manufactured by TOAGOSEI Co., Ltd.) | 13.3 parts |
| Silicone oil (X-22-173DX, solid content 100% by weight; manufactured by Shin-Etsu chemical Co., Ltd.) | 2.0 parts |
| Talc (MICRO ACE P-3, solid content 100% by weight; manufactured by Nippon Talc Co., Ltd.) | 5.0 parts |
| Methyl ethyl ketone | 485.5 parts |
| Toluene | 485.4 parts |

EXAMPLE 31

A heat resistant slipping layer-formed sheet of Example 31 was prepared in the same manner as in Example 20 except that the coating liquid A for a heat resistant slipping layer was changed to a coating liquid L for a heat resistant slipping layer having the following composition to form a heat resistant slipping layer.

| <Coating liquid L for heat resistant slipping layer> | |
|---|---|
| CAB resin (CAB 551-0.01, solid content 100% by weight, manufactured by Eastman Chemical Company) | 75.0 parts |
| Acrylic resin (DIANAL BR-83, solid content 100% by weight, manufactured by MITSUBISHI RAYON Co., Ltd.) | 25.0 parts |
| Zinc stearyl phosphate (SZ-PF, solid content 100% by weight; manufactured by Sakai Chemical Industry Co., Ltd.) | 4.0 parts |

-continued

| <Coating liquid L for heat resistant slipping layer> | |
|---|---|
| Silicone modified acrylic resin (Symac US-380, solid content 30% by weight, manufactured by TOAGOSEI Co., Ltd.) | 13.3 parts |
| Phosphate ester (PLYSURF A-208N, solid content 100% by weight; manufactured by DAI-ICHI KOGYO SEIYAKU Co., Ltd.) | 2.0 parts |
| Talc (MICRO ACE P-3, solid content 100% by weight; manufactured by Nippon Talc Co., Ltd.) | 5.0 parts |
| Methyl ethyl ketone | 485.5 parts |
| Toluene | 485.4 parts |

EXAMPLE 32

A heat resistant slipping layer-formed sheet of Example 32 was prepared in the same manner as in Example 20 except that the coating liquid A for a heat resistant slipping layer was changed to a coating liquid M for a heat resistant slipping layer having the following composition to form a heat resistant slipping layer.

| <Coating liquid M for heat resistant slipping layer> | |
|---|---|
| CAB resin (CAB 551-0.01, solid content 100% by weight, manufactured by Eastman Chemical Company) | 75.0 parts |
| Acrylic resin (DIANAL BR-83, solid content 100% by weight, manufactured by MITSUBISHI RAYON Co., Ltd.) | 25.0 parts |
| Zinc stearyl phosphate (SZ-PF, solid content 100% by weight; manufactured by Sakai Chemical Industry Co., Ltd.) | 5.0 parts |
| Silicone modified acrylic resin (Symac US-380, solid content 30% by weight, manufactured by TOAGOSEI Co., Ltd.) | 16.7 parts |
| Mica (MK-100, solid content 100% by weigh, manufactured by CO-OP CHEMICAL Co., Ltd.) | 5.0 parts |
| Methyl ethyl ketone | 484.5 parts |
| Toluene | 484.5 parts |

EXAMPLE 33

A heat resistant slipping layer-formed sheet of Example 33 was prepared in the same manner as in Example 20 except that the coating liquid A for a heat resistant slipping layer was changed to a coating liquid N for a heat resistant slipping layer having the following composition to form a heat resistant slipping layer.

| <Coating liquid N for heat resistant slipping layer> | |
|---|---|
| CAB resin (CAB 551-0.01, solid content 100% by weight, manufactured by Eastman Chemical Company) | 75.0 parts |
| Acrylic resin (DIANAL BR-83, solid content 100% by weight, manufactured by MITSUBISHI RAYON Co., Ltd.) | 25.0 parts |
| Zinc stearyl phosphate (SZ-PF, solid content 100% by weight; manufactured by Sakai Chemical Industry Co., Ltd.) | 5.0 parts |
| Silicone modified acrylic resin (Symac US-380, solid content 30% by weight, manufactured by TOAGOSEI Co., Ltd.) | 16.7 parts |
| Silicone rubber filler (KM-597, solid content 100% by weight, manufactured by Shin-Etsu chemical Co., Ltd.) | 5.0 parts |
| Methyl ethyl ketone | 484.5 parts |
| Toluene | 484.5 parts |

EXAMPLE 34

A heat resistant slipping layer-formed sheet of Example 34 was prepared in the same manner as in Example 20 except that the coating liquid A for a heat resistant slipping layer was changed to a coating liquid 0 for a heat resistant slipping layer having the following composition to form a heat resistant slipping layer.

| <Coating liquid O for heat resistant slipping layer> | |
|---|---|
| CAB resin (CAB 551-0.01, solid content 100% by weight, manufactured by Eastman Chemical Company) | 75.0 parts |
| Acrylic resin (DIANAL BR-83, solid content 100% by weight, manufactured by MITSUBISHI RAYON Co., Ltd.) | 25.0 parts |
| Zinc stearyl phosphate (SZ-PF, solid content 100% by weight; manufactured by Sakai Chemical Industry Co., Ltd.) | 5.0 parts |
| Silicone modified acrylic resin (Symac US-380, solid content 30% by weight, manufactured by TOAGOSEI Co., Ltd.) | 16.7 parts |
| Talc (MICRO ACE P-3, solid content 100% by weight; manufactured by Nippon Talc Co., Ltd.) | 5.0 parts |
| Isocyanate compound (CROSSNATE D-70, solid content 50% by weight; manufactured by Dainichiseika Color & Chemicals Mfg. Co., Ltd.) | 15.0 parts |
| Methyl ethyl ketone | 512.5 parts |
| Toluene | 512.5 parts |

EXAMPLE 35

A heat resistant slipping layer-formed sheet of Example 35 was prepared in the same manner as in Example 20 except that the coating liquid A for a heat resistant slipping layer was changed to a coating liquid P for a heat resistant slipping layer having the following composition to form a heat resistant slipping layer.

| <Coating liquid P for heat resistant slipping layer> | |
|---|---|
| CAB resin (CAB 551-0.01, solid content 100% by weight, manufactured by Eastman Chemical Company) | 75.0 parts |
| Acrylic resin (DIANAL BR-83, solid content 100% by weight, manufactured by MITSUBISHI RAYON Co., Ltd.) | 25.0 parts |
| Zinc stearyl phosphate (SZ-PF, solid content 100% by weight; manufactured by Sakai Chemical Industry Co., Ltd.) | 5.0 parts |
| Silicone modified acrylic resin (Symac US-380, solid content 30% by weight, manufactured by TOAGOSEI Co., Ltd.) | 16.7 parts |
| Talc (MICRO ACE P-3, solid content 100% by weight; manufactured by Nippon Talc Co., Ltd.) | 5.0 parts |
| Isocyanate compound (DAIAROMER SP-901, solid content 15% by weight; manufactured by Dainichiseika Color & Chemicals Mfg. Co., Ltd.) | 50.0 parts |
| Methyl ethyl ketone | 495.0 parts |
| Toluene | 495.0 parts |

EXAMPLE 36

A heat resistant slipping layer-formed sheet of Example 36 was prepared in the same manner as in Example 20 except that the coating liquid A for a heat resistant slipping layer was changed to a coating liquid Q for a heat resistant slipping layer having the following composition to form a heat resistant slipping layer.

| <Coating liquid Q for heat resistant slipping layer> | |
|---|---|
| CAB resin (CAB 551-0.01, solid content 100% by weight, manufactured by Eastman Chemical Company) | 60.0 parts |
| Acrylic resin (DIANAL BR-83, solid content 100% by weight, manufactured by MITSUBISHI RAYON Co., Ltd.) | 40.0 parts |
| Zinc stearyl phosphate (SZ-PF, solid content 100% by weight; manufactured by Sakai Chemical Industry Co., Ltd.) | 5.0 parts |
| Silicone modified acrylic resin (Symac US-380, solid content 30% by weight, manufactured by TOAGOSEI Co., Ltd.) | 16.7 parts |
| Talc (MICRO ACE P-3, solid content 100% by weight; manufactured by Nippon Talc Co., Ltd.) | 5.0 parts |
| Methyl ethyl ketone | 484.5 parts |
| Toluene | 484.5 parts |

EXAMPLE 37

A heat resistant slipping layer-formed sheet of Example 37 was prepared in the same manner as in Example 20 except that the coating liquid A for a heat resistant slipping layer was changed to a coating liquid R for a heat resistant slipping layer having the following composition to form a heat resistant slipping layer.

| <Coating liquid R for heat resistant slipping layer> | |
|---|---|
| CAB resin (CAB 551-0.01, solid content 100% by weight, manufactured by Eastman Chemical Company) | 60.0 parts |
| Acrylic resin (DIANAL BR-83, solid content 100% by weight, manufactured by MITSUBISHI RAYON Co., Ltd.) | 40.0 parts |
| Zinc stearyl phosphate (SZ-PF, solid content 100% by weight; manufactured by Sakai Chemical Industry Co., Ltd.) | 5.0 parts |
| Silicone modified acrylic resin (Modiper FS-720, solid content 15% by weight, manufactured by NOF Corporation) | 33.3 parts |
| Talc (MICRO ACE P-3, solid content 100% by weight; manufactured by Nippon Talc Co., Ltd.) | 5.0 parts |
| Methyl ethyl ketone | 476.0 parts |
| Toluene | 476.0 parts |

EXAMPLE 38

A heat resistant slipping layer-formed sheet of Example 38 was prepared in the same manner as in Example 20 except that the coating liquid A for a heat resistant slipping layer was changed to a coating liquid S for a heat resistant slipping layer having the following composition to form a heat resistant slipping layer.

| <Coating liquid S for heat resistant slipping layer> | |
|---|---|
| CAB resin (CAB 551-0.01, solid content 100% by weight, manufactured by Eastman Chemical Company) | 60.0 parts |
| Acrylic resin (DIANAL BR-83, solid content 100% by weight, manufactured by MITSUBISHI RAYON Co., Ltd.) | 40.0 parts |
| Zinc stearyl phosphate (SZ-PF, solid content 100% by weight; manufactured by Sakai Chemical Industry Co., Ltd.) | 5.0 parts |
| Silicone modified acrylic resin (Symac US-380, solid content 30% by weight, manufactured by TOAGOSEI Co., Ltd.) | 16.7 parts |

-continued

| <Coating liquid S for heat resistant slipping layer> | |
|---|---|
| Talc (MICRO ACE P-3, solid content 100% by weight; manufactured by Nippon Talc Co., Ltd.) | 5.0 parts |
| Isocyanate compound (CROSSNATE D-70, solid content 50% by weight; manufactured by Dainichiseika Color & Chemicals Mfg. Co., Ltd.) | 15.0 parts |
| Methyl ethyl ketone | 512.5 parts |
| Toluene | 512.5 parts |

EXAMPLE 39

A heat resistant slipping layer-formed sheet of Example 39 was prepared in the same manner as in Example 20 except that the coating liquid A for a heat resistant slipping layer was changed to a coating liquid T for a heat resistant slipping layer having the following composition to form a heat resistant slipping layer.

| <Coating liquid T for heat resistant slipping layer> | |
|---|---|
| CAB resin (CAB 551-0.01, solid content 100% by weight, manufactured by Eastman Chemical Company) | 90.0 parts |
| Acrylic resin (DIANAL BR-83, solid content 100% by weight, manufactured by MITSUBISHI RAYON Co., Ltd.) | 10.0 parts |
| Zinc stearyl phosphate (SZ-PF, solid content 100% by weight; manufactured by Sakai Chemical Industry Co., Ltd.) | 5.0 parts |
| Silicone modified acrylic resin (Symac US-380, solid content 30% by weight, manufactured by TOAGOSEI Co., Ltd.) | 16.7 parts |
| Talc (MICRO ACE P-3, solid content 100% by weight; manufactured by Nippon Talc Co., Ltd.) | 5.0 parts |
| Methyl ethyl ketone | 484.5 parts |
| Toluene | 484.5 parts |

EXAMPLE 40

A heat resistant slipping layer-formed sheet of Example 40 was prepared in the same manner as in Example 20 except that the coating liquid A for a heat resistant slipping layer was changed to a coating liquid U for a heat resistant slipping layer having the following composition to form a heat resistant slipping layer.

| <Coating liquid U for heat resistant slipping layer> | |
|---|---|
| CAB resin (CAB 551-0.01, solid content 100% by weight, manufactured by Eastman Chemical Company) | 90.0 parts |
| Acrylic resin (DIANAL BR-83, solid content 100% by weight, manufactured by MITSUBISHI RAYON Co., Ltd.) | 10.0 parts |
| Zinc stearyl phosphate (SZ-PF, solid content 100% by weight; manufactured by Sakai Chemical Industry Co., Ltd.) | 5.0 parts |
| Silicone modified acrylic resin (Modiper FS-720, solid content 15% by weight, manufactured by NOF Corporation) | 33.3 parts |
| Talc (MICRO ACE P-3, solid content 100% by weight; manufactured by Nippon Talc Co., Ltd.) | 5.0 parts |
| Methyl ethyl ketone | 476.0 parts |
| Toluene | 476.0 parts |

EXAMPLE 41

A heat resistant slipping layer-formed sheet of Example 41 was prepared in the same manner as in Example 20 except that the coating liquid A for a heat resistant slipping layer was changed to a coating liquid V for a heat resistant slipping layer having the following composition to form a heat resistant slipping layer.

| <Coating liquid V for heat resistant slipping layer> | |
|---|---|
| CAB resin (CAB 551-0.01, solid content 100% by weight, manufactured by Eastman Chemical Company) | 90.0 parts |
| Acrylic resin (DIANAL BR-83, solid content 100% by weight, manufactured by MITSUBISHI RAYON Co., Ltd.) | 10.0 parts |
| Zinc stearyl phosphate (SZ-PF, solid content 100% by weight; manufactured by Sakai Chemical Industry Co., Ltd.) | 5.0 parts |
| Silicone modified acrylic resin (Symac US-380, solid content 30% by weight, manufactured by TOAGOSEI Co., Ltd.) | 16.7 parts |
| Talc (MICRO ACE P-3, solid content 100% by weight; manufactured by Nippon Talc Co., Ltd.) | 5.0 parts |
| Isocyanate compound (CROSSNATE D-70, solid content 50% by weight; manufactured by Dainichiseika Color & Chemicals Mfg. Co., Ltd.) | 15.0 parts |
| Methyl ethyl ketone | 512.5 parts |
| Toluene | 512.5 parts |

EXAMPLE 42

A heat resistant slipping layer-formed sheet of Example 42 was prepared in the same manner as in Example 20 except that the coating liquid A for a heat resistant slipping layer was changed to a coating liquid W for a heat resistant slipping layer having the following composition to form a heat resistant slipping layer.

| <Coating liquid W for heat resistant slipping layer> | |
|---|---|
| CAB resin (CAB 500-5, solid content 100% by weight, manufactured by Eastman Chemical Company) | 60.0 parts |
| Acrylic resin (DIANAL BR-83, solid content 100% by weight, manufactured by MITSUBISHI RAYON Co., Ltd.) | 40.0 parts |
| Zinc stearyl phosphate (SZ-PF, solid content 100% by weight; manufactured by Sakai Chemical Industry Co., Ltd.) | 5.0 parts |
| Silicone modified acrylic resin (Symac US-380, solid content 30% by weight, manufactured by TOAGOSEI Co., Ltd.) | 16.7 parts |
| Talc (MICRO ACE P-3, solid content 100% by weight; manufactured by Nippon Talc Co., Ltd.) | 5.0 parts |
| Methyl ethyl ketone | 484.5 parts |
| Toluene | 484.5 parts |

EXAMPLE 43

A heat resistant slipping layer-formed sheet of Example 43 was prepared in the same manner as in Example 20 except that the coating liquid A for a heat resistant slipping layer was changed to a coating liquid X for a heat resistant slipping layer having the following composition to form a heat resistant slipping layer.

| <Coating liquid X for heat resistant slipping layer> | |
|---|---|
| CAB resin (CAB 500-5, solid content 100% by weight, manufactured by Eastman Chemical Company) | 90.0 parts |

-continued

| <Coating liquid X for heat resistant slipping layer> | |
|---|---|
| Acrylic resin (DIANAL BR-83, solid content 100% by weight, manufactured by MITSUBISHI RAYON Co., Ltd.) | 10.0 parts |
| Zinc stearyl phosphate (SZ-PF, solid content 100% by weight; manufactured by Sakai Chemical Industry Co., Ltd.) | 5.0 parts |
| Silicone modified acrylic resin (Symac US-380, solid content 30% by weight, manufactured by TOAGOSEI Co., Ltd.) | 16.7 parts |
| Talc (MICRO ACE P-3, solid content 100% by weight; manufactured by Nippon Talc Co., Ltd.) | 5.0 parts |
| Methyl ethyl ketone | 484.5 parts |
| Toluene | 484.5 parts |

EXAMPLE 44

A heat resistant slipping layer-formed sheet of Example 44 was prepared in the same manner as in Example 20 except that the coating liquid A for a heat resistant slipping layer was changed to a coating liquid Y for a heat resistant slipping layer having the following composition to form a heat resistant slipping layer.

| <Coating liquid Y for heat resistant slipping layer> | |
|---|---|
| CAB resin (CAB 531-1, solid content 100% by weight, manufactured by Eastman Chemical Company) | 60.0 parts |
| Acrylic resin (DIANAL BR-83, solid content 100% by weight, manufactured by MITSUBISHI RAYON Co., Ltd.) | 40.0 parts |
| Zinc stearyl phosphate (SZ-PF, solid content 100% by weight; manufactured by Sakai Chemical Industry Co., Ltd.) | 5.0 parts |
| Silicone modified acrylic resin (Symac US-380, solid content 30% by weight, manufactured by TOAGOSEI Co., Ltd.) | 16.7 parts |
| Talc (MICRO ACE P-3, solid content 100% by weight; manufactured by Nippon Talc Co., Ltd.) | 5.0 parts |
| Methyl ethyl ketone | 484.5 parts |
| Toluene | 484.5 parts |

EXAMPLE 45

A heat resistant slipping layer-formed sheet of Example 45 was prepared in the same manner as in Example 20 except that the coating liquid A for a heat resistant slipping layer was changed to a coating liquid Z for a heat resistant slipping layer having the following composition to form a heat resistant slipping layer.

| <Coating liquid Z for heat resistant slipping layer> | |
|---|---|
| CAB resin (CAB 531-1, solid content 100% by weight, manufactured by Eastman Chemical Company) | 90.0 parts |
| Acrylic resin (DIANAL BR-83, solid content 100% by weight, manufactured by MITSUBISHI RAYON Co., Ltd.) | 10.0 parts |
| Zinc stearyl phosphate (SZ-PF, solid content 100% by weight; manufactured by Sakai Chemical Industry Co., Ltd.) | 5.0 parts |
| Silicone modified acrylic resin (Symac US-380, solid content 30% by weight, manufactured by TOAGOSEI Co., Ltd.) | 16.7 parts |
| Talc (MICRO ACE P-3, solid content 100% by weight; manufactured by Nippon Talc Co., Ltd.) | 5.0 parts |
| Methyl ethyl ketone | 484.5 parts |
| Toluene | 484.5 parts |

-continued

| <Coating liquid Z for heat resistant slipping layer> | |
|---|---|
| Methyl ethyl ketone | 484.5 parts |
| Toluene | 484.5 parts |

EXAMPLE 46

A heat resistant slipping layer-formed sheet of Example 46 was prepared in the same manner as in Example 20 except that the coating liquid A for a heat resistant slipping layer was changed to a coating liquid a for a heat resistant slipping layer having the following composition to form a heat resistant slipping layer.

| <Coating liquid a for heat resistant slipping layer> | |
|---|---|
| CAB resin (CAB 551-0.01, solid content 100% by weight, manufactured by Eastman Chemical Company) | 60.0 parts |
| Acrylic resin (DIANAL BR-100, solid content 100% by weight, manufactured by MITSUBISHI RAYON Co., Ltd.) | 40.0 parts |
| Zinc stearyl phosphate (SZ-PF, solid content 100% by weight; manufactured by Sakai Chemical Industry Co., Ltd.) | 5.0 parts |
| Silicone modified acrylic resin (Symac US-380, solid content 30% by weight, manufactured by TOAGOSEI Co., Ltd.) | 16.7 parts |
| Talc (MICRO ACE P-3, solid content 100% by weight; manufactured by Nippon Talc Co., Ltd.) | 5.0 parts |
| Methyl ethyl ketone | 484.5 parts |
| Toluene | 484.5 parts |

EXAMPLE 47

A heat resistant slipping layer-formed sheet of Example 47 was prepared in the same manner as in Example 20 except that the coating liquid A for a heat resistant slipping layer was changed to a coating liquid b for a heat resistant slipping layer having the following composition to form a heat resistant slipping layer.

| <Coating liquid b for heat resistant slipping layer> | |
|---|---|
| CAB resin (CAB 551-0.01, solid content 100% by weight, manufactured by Eastman Chemical Company) | 90.0 parts |
| Acrylic resin (DIANAL BR-100, solid content 100% by weight, manufactured by MITSUBISHI RAYON Co., Ltd.) | 10.0 parts |
| Zinc stearyl phosphate (SZ-PF, solid content 100% by weight; manufactured by Sakai Chemical Industry Co., Ltd.) | 5.0 parts |
| Silicone modified acrylic resin (Symac US-380, solid content 30% by weight, manufactured by TOAGOSEI Co., Ltd.) | 16.7 parts |
| Talc (MICRO ACE P-3, solid content 100% by weight; manufactured by Nippon Talc Co., Ltd.) | 5.0 parts |
| Methyl ethyl ketone | 484.5 parts |
| Toluene | 484.5 parts |

EXAMPLE 48

A heat resistant slipping layer-formed sheet of Example 48 was prepared in the same manner as in Example 20 except that the coating liquid A for a heat resistant slipping layer was changed to a coating liquid c for a heat resistant slipping layer having the following composition to form a heat resistant slipping layer.

| <Coating liquid c for heat resistant slipping layer> | |
|---|---|
| CAB resin (CAB 551-0.01, solid content 100% by weight, manufactured by Eastman Chemical Company) | 60.0 parts |
| Acrylic polyol resin (ACRIT 6AN-213, solid content 50% by weight; manufactured by TAISEI CHEMICAL INDUSTRIES, Ltd.) | 80.0 parts |
| Zinc stearyl phosphate (SZ-PF, solid content 100% by weight; manufactured by Sakai Chemical Industry Co., Ltd.) | 5.0 parts |
| Silicone modified acrylic resin (Symac US-380, solid content 30% by weight, manufactured by TOAGOSEI Co., Ltd.) | 16.7 parts |
| Talc (MICRO ACE P-3, solid content 100% by weight; manufactured by Nippon Talc Co., Ltd.) | 5.0 parts |
| Methyl ethyl ketone | 464.5 parts |
| Toluene | 464.5 parts |

EXAMPLE 49

A heat resistant slipping layer-formed sheet of Example 49 was prepared in the same manner as in Example 20 except that the coating liquid A for a heat resistant slipping layer was changed to a coating liquid d for a heat resistant slipping layer having the following composition to form a heat resistant slipping layer.

| <Coating liquid d for heat resistant slipping layer> | |
|---|---|
| CAB resin (CAB 551-0.01, solid content 100% by weight, manufactured by Eastman Chemical Company) | 90.0 parts |
| Acrylic polyol resin (ACRIT 6AN-213, solid content 50% by weight; manufactured by TAISEI CHEMICAL INDUSTRIES, Ltd.) | 20.0 parts |
| Zinc stearyl phosphate (SZ-PF, solid content 100% by weight; manufactured by Sakai Chemical Industry Co., Ltd.) | 5.0 parts |
| Silicone modified acrylic resin (Symac US-380, solid content 30% by weight, manufactured by TOAGOSEI Co., Ltd.) | 16.7 parts |
| Talc (MICRO ACE P-3, solid content 100% by weight; manufactured by Nippon Talc Co., Ltd.) | 5.0 parts |
| Methyl ethyl ketone | 479.5 parts |
| Toluene | 479.5 parts |

EXAMPLE 50

A heat resistant slipping layer-formed sheet of Example 50 was prepared in the same manner as in Example 20 except that the coating liquid A for a heat resistant slipping layer was changed to a coating liquid e for a heat resistant slipping layer having the following composition to form a heat resistant slipping layer.

| <Coating liquid e for heat resistant slipping layer> | |
|---|---|
| CAB resin (CAB 551-0.01, solid content 100% by weight, manufactured by Eastman Chemical Company) | 60.0 parts |
| Styrene-acrylic resin (ESTYRENE MS-600, solid content 100% by weight; manufactured by Nippon Steel Chemical Co., Ltd.) | 40.0 parts |

-continued

| <Coating liquid e for heat resistant slipping layer> | |
|---|---|
| Zinc stearyl phosphate (SZ-PF, solid content 100% by weight; manufactured by Sakai Chemical Industry Co., Ltd.) | 5.0 parts |
| Silicone modified acrylic resin (Symac US-380, solid content 30% by weight, manufactured by TOAGOSEI Co., Ltd.) | 16.7 parts |
| Talc (MICRO ACE P-3, solid content 100% by weight; manufactured by Nippon Talc Co., Ltd.) | 5.0 parts |
| Methyl ethyl ketone | 484.5 parts |
| Toluene | 484.5 parts |

EXAMPLE 51

A heat resistant slipping layer-formed sheet of Example 51 was prepared in the same manner as in Example 20 except that the coating liquid A for a heat resistant slipping layer was changed to a coating liquid f for a heat resistant slipping layer having the following composition to form a heat resistant slipping layer.

| <Coating liquid f for heat resistant slipping layer> | |
|---|---|
| CAB resin (CAB 551-0.01, solid content 100% by weight, manufactured by Eastman Chemical Company) | 90.0 parts |
| Styrene-acrylic resin (ESTYRENE MS-600, solid content 100% by weight; manufactured by Nippon Steel Chemical Co., Ltd.) | 10.0 parts |
| Zinc stearyl phosphate (SZ-PF, solid content 100% by weight; manufactured by Sakai Chemical Industry Co., Ltd.) | 5.0 parts |
| Silicone modified acrylic resin (Symac US-380, solid content 30% by weight, manufactured by TOAGOSEI Co., Ltd.) | 16.7 parts |
| Talc (MICRO ACE P-3, solid content 100% by weight; manufactured by Nippon Talc Co., Ltd.) | 5.0 parts |
| Methyl ethyl ketone | 484.5 parts |
| Toluene | 484.5 parts |

EXAMPLE 52

A heat resistant slipping layer-formed sheet of Example 52 was prepared in the same manner as in Example 20 except that the coating liquid A for a heat resistant slipping layer was changed to a coating liquid g for a heat resistant slipping layer having the following composition to form a heat resistant slipping layer.

| <Coating liquid g for heat resistant slipping layer> | |
|---|---|
| CAB resin (CAB 551-0.01, solid content 100% by weight, manufactured by Eastman Chemical Company) | 60.0 parts |
| Polyvinyl acetal resin (S-LEC KS-1, solid content 100% by weight; manufactured by SEKISUI CHEMICAL Co., Ltd.) | 40.0 parts |
| Zinc stearyl phosphate (SZ-PF, solid content 100% by weight; manufactured by Sakai Chemical Industry Co., Ltd.) | 5.0 parts |
| Silicone modified acrylic resin (Symac US-380, solid content 30% by weight, manufactured by TOAGOSEI Co., Ltd.) | 16.7 parts |
| Talc (MICRO ACE P-3, solid content 100% by weight; manufactured by Nippon Talc Co., Ltd.) | 5.0 parts |
| Methyl ethyl ketone | 484.5 parts |
| Toluene | 484.5 parts |

EXAMPLE 53

A heat resistant slipping layer-formed sheet of Example 53 was prepared in the same manner as in Example 20 except that the coating liquid A for a heat resistant slipping layer was changed to a coating liquid h for a heat resistant slipping layer having the following composition to form a heat resistant slipping layer.

| <Coating liquid h for heat resistant slipping layer> | |
|---|---|
| CAB resin (CAB 551-0.01, solid content 100% by weight, manufactured by Eastman Chemical Company) | 90.0 parts |
| Polyvinyl acetal resin (S-LEC KS-1, solid content 100% by weight; manufactured by SEKISUI CHEMICAL Co., Ltd.) | 10.0 parts |
| Zinc stearyl phosphate (SZ-PF, solid content 100% by weight; manufactured by Sakai Chemical Industry Co., Ltd.) | 5.0 parts |
| Silicone modified acrylic resin (Symac US-380, solid content 30% by weight, manufactured by TOAGOSEI Co., Ltd.) | 16.7 parts |
| Talc (MICRO ACE P-3, solid content 100% by weight; manufactured by Nippon Talc Co., Ltd.) | 5.0 parts |
| Methyl ethyl ketone | 484.5 parts |
| Toluene | 484.5 parts |

EXAMPLE 54

A heat resistant slipping layer-formed sheet of Example 54 was prepared in the same manner as in Example 20 except that the coating liquid A for a heat resistant slipping layer was changed to a coating liquid i for a heat resistant slipping layer having the following composition to form a heat resistant slipping layer.

| <Coating liquid i for heat resistant slipping layer> | |
|---|---|
| CAB resin (CAB 551-0.01, solid content 100% by weight, manufactured by Eastman Chemical Company) | 60.0 parts |
| Polyvinyl butyral resin (S-LEC BX-1, solid content 100% by weight; manufactured by SEKISUI CHEMICAL Co., Ltd.) | 40.0 parts |
| Zinc stearyl phosphate (SZ-PF, solid content 100% by weight; manufactured by Sakai Chemical Industry Co., Ltd.) | 5.0 parts |
| Silicone modified acrylic resin (Symac US-380, solid content 30% by weight, manufactured by TOAGOSEI Co., Ltd.) | 16.7 parts |
| Talc (MICRO ACE P-3, solid content 100% by weight; manufactured by Nippon Talc Co., Ltd.) | 5.0 parts |
| Methyl ethyl ketone | 484.5 parts |
| Toluene | 484.5 parts |

EXAMPLE 55

A heat resistant slipping layer-formed sheet of Example 55 was prepared in the same manner as in Example 20 except that the coating liquid A for a heat resistant slipping layer was changed to a coating liquid j for a heat resistant slipping layer having the following composition to form a heat resistant slipping layer.

| <Coating liquid j for heat resistant slipping layer> | |
|---|---|
| CAB resin (CAB 551-0.01, solid content 100% by weight, manufactured by Eastman Chemical Company) | 90.0 parts |
| Polyvinyl butyral resin (S-LEC BX-1, solid content 100% by weight; manufactured by SEKISUI CHEMICAL Co., Ltd.) | 10.0 parts |
| Zinc stearyl phosphate (SZ-PF, solid content 100% by weight; manufactured by Sakai Chemical Industry Co., Ltd.) | 5.0 parts |
| Silicone modified acrylic resin (Symac US-380, solid content 30% by weight, manufactured by TOAGOSEI Co., Ltd.) | 16.7 parts |
| Talc (MICRO ACE P-3, solid content 100% by weight; manufactured by Nippon Talc Co., Ltd.) | 5.0 parts |
| Methyl ethyl ketone | 484.5 parts |
| Toluene | 484.5 parts |

EXAMPLE 56

A heat resistant slipping layer-formed sheet of Example 56 was prepared in the same manner as in Example 20 except that the coating liquid A for a heat resistant slipping layer was changed to a coating liquid k for a heat resistant slipping layer having the following composition to form a heat resistant slipping layer.

| <Coating liquid k for heat resistant slipping layer> | |
|---|---|
| CAB resin (CAB 551-0.01, solid content 100% by weight, manufactured by Eastman Chemical Company) | 75.0 parts |
| Acrylic resin (DIANAL BR-83, solid content 100% by weight, manufactured by MITSUBISHI RAYON Co., Ltd.) | 12.5 parts |
| Acrylic polyol resin (ACRIT 6AN-213, solid content 50% by weight; manufactured by TAISEI CHEMICAL INDUSTRIES, Ltd.) | 25.0 parts |
| Zinc stearyl phosphate (SZ-PF, solid content 100% by weight; manufactured by Sakai Chemical Industry Co., Ltd.) | 5.0 parts |
| Silicone modified acrylic resin (Symac US-380, solid content 30% by weight, manufactured by TOAGOSEI Co., Ltd.) | 16.7 parts |
| Talc (MICRO ACE P-3, solid content 100% by weight; manufactured by Nippon Talc Co., Ltd.) | 5.0 parts |
| Methyl ethyl ketone | 454.5 parts |
| Toluene | 454.5 parts |

EXAMPLE 57

A heat resistant slipping layer-formed sheet of Example 57 was prepared in the same manner as in Example 20 except that the coating liquid A for a heat resistant slipping layer was changed to a coating liquid 1 for a heat resistant slipping layer having the following composition to form a heat resistant slipping layer.

| <Coating liquid 1 for heat resistant slipping layer> | |
|---|---|
| CAB resin (CAB 551-0.01, solid content 100% by weight, manufactured by Eastman Chemical Company) | 75.0 parts |
| Acrylic resin (DIANAL BR-83, solid content 100% by weight, manufactured by MITSUBISHI RAYON Co., Ltd.) | 12.5 parts |
| Polyvinyl acetal resin (S-LEC KS-1, solid content 100% by weight; manufactured by SEKISUI CHEMICAL Co., Ltd.) | 12.5 parts |

-continued

| <Coating liquid 1 for heat resistant slipping layer> | |
|---|---|
| Zinc stearyl phosphate (SZ-PF, solid content 100% by weight; manufactured by Sakai Chemical Industry Co., Ltd.) | 5.0 parts |
| Silicone modified acrylic resin (Symac US-380, solid content 30% by weight, manufactured by TOAGOSEI Co., Ltd.) | 16.7 parts |
| Talc (MICRO ACE P-3, solid content 100% by weight; manufactured by Nippon Talc Co., Ltd.) | 5.0 parts |
| Methyl ethyl ketone | 484.5 parts |
| Toluene | 484.5 parts |

EXAMPLE 58

A heat resistant slipping layer-formed sheet of Example 58 was prepared in the same manner as in Example 20 except that the coating liquid A for a heat resistant slipping layer was changed to a coating liquid m for a heat resistant slipping layer having the following composition to form a heat resistant slipping layer.

| <Coating liquid m for heat resistant slipping layer> | |
|---|---|
| CAB resin (CAB 551-0.01, solid content 100% by weight, manufactured by Eastman Chemical Company) | 100.0 parts |
| Zinc stearyl phosphate (SZ-PF, solid content 100% by weight; manufactured by Sakai Chemical Industry Co., Ltd.) | 5.0 parts |
| Silicone modified acrylic resin (Symac US-380, solid content 30% by weight, manufactured by TOAGOSEI Co., Ltd.) | 16.7 parts |
| Talc (MICRO ACE P-3, solid content 100% by weight; manufactured by Nippon Talc Co., Ltd.) | 5.0 parts |
| Methyl ethyl ketone | 484.5 parts |
| Toluene | 484.5 parts |

EXAMPLE 59

A heat resistant slipping layer-formed sheet of Example 59 was prepared in the same manner as in Example 20 except that the coating liquid A for a heat resistant slipping layer was changed to a coating liquid n for a heat resistant slipping layer having the following composition to form a heat resistant slipping layer.

| <Coating liquid n for heat resistant slipping layer> | |
|---|---|
| CAB resin (CAB 551-0.01, solid content 100% by weight, manufactured by Eastman Chemical Company) | 100.0 parts |
| Zinc stearyl phosphate (SZ-PF, solid content 100% by weight; manufactured by Sakai Chemical Industry Co., Ltd.) | 5.0 parts |
| Silicone modified acrylic resin (Symac US-380, solid content 30% by weight, manufactured by TOAGOSEI Co., Ltd.) | 16.7 parts |
| Talc (MICRO ACE P-3, solid content 100% by weight; manufactured by Nippon Talc Co., Ltd.) | 5.0 parts |
| Isocyanate compound (CROSSNATE D-70, solid content 50% by weight; manufactured by Dainichiseika Color & Chemicals Mfg. Co., Ltd.) | 15.0 parts |
| Methyl ethyl ketone | 512.5 parts |
| Toluene | 512.5 parts |

EXAMPLE 60

A heat resistant slipping layer-formed sheet of Example 60 was prepared in the same manner as in Example 20 except that the coating liquid A for a heat resistant slipping layer was changed to a coating liquid o for a heat resistant slipping layer having the following composition to form a heat resistant slipping layer.

| <Coating liquid o for heat resistant slipping layer> | |
|---|---|
| CAB resin (CAB 551-0.01, solid content 100% by weight, manufactured by Eastman Chemical Company) | 100.0 parts |
| Zinc stearyl phosphate (SZ-PF, solid content 100% by weight; manufactured by Sakai Chemical Industry Co., Ltd.) | 5.0 parts |
| Silicone modified acrylic resin (Symac US-380, solid content 30% by weight, manufactured by TOAGOSEI Co., Ltd.) | 16.7 parts |
| Talc (MICRO ACE P-3, solid content 100% by weight; manufactured by Nippon Talc Co., Ltd.) | 5.0 parts |
| Isocyanate compound (CROSSNATE D-70, solid content 50% by weight; manufactured by Dainichiseika Color & Chemicals Mfg. Co., Ltd.) | 30.0 parts |
| Methyl ethyl ketone | 540.5 parts |
| Toluene | 540.5 parts |

EXAMPLE 61

A heat resistant slipping layer-formed sheet of Example 61 was prepared in the same manner as in Example 20 except that the coating liquid A for a heat resistant slipping layer was changed to a coating liquid p for a heat resistant slipping layer having the following composition to form a heat resistant slipping layer.

| <Coating liquid p for heat resistant slipping layer> | |
|---|---|
| CAB resin (CAB 551-0.01, solid content 100% by weight, manufactured by Eastman Chemical Company) | 100.0 parts |
| Silicone modified acrylic resin (Symac US-380, solid content 30% by weight, manufactured by TOAGOSEI Co., Ltd.) | 16.7 parts |
| Phosphate ester (PLYSURF A-208N, solid content 100% by weight; manufactured by DAI-ICHI KOGYO SEIYAKU Co., Ltd.) | 3.0 parts |
| Talc (MICRO ACE P-3, solid content 100% by weight; manufactured by Nippon Talc Co., Ltd.) | 5.0 parts |
| Methyl ethyl ketone | 476.0 parts |
| Toluene | 476.0 parts |

EXAMPLE 62

A heat resistant slipping layer-formed sheet of Example 62 was prepared in the same manner as in Example 20 except that the coating liquid A for a heat resistant slipping layer was changed to a coating liquid q for a heat resistant slipping layer having the following composition to form a heat resistant slipping layer.

| <Coating liquid q for heat resistant slipping layer> | |
|---|---|
| CAB resin (CAB 551-0.01, solid content 100% by weight, manufactured by Eastman Chemical Company) | 100.0 parts |
| Silicone modified acrylic resin (Symac US-380, solid content 30% by weight, manufactured by TOAGOSEI Co., Ltd.) | 16.7 parts |
| Phosphate ester (PLYSURF A-208N, solid content 100% by weight; manufactured by DAI-ICHI KOGYO SEIYAKU Co., Ltd.) | 3.0 parts |

-continued

| <Coating liquid q for heat resistant slipping layer> | |
|---|---|
| Talc (MICRO ACE P-3, solid content 100% by weight; manufactured by Nippon Talc Co., Ltd.) | 5.0 parts |
| Isocyanate compound (CROSSNATE D-70, solid content 50% by weight; manufactured by Dainichiseika Color & Chemicals Mfg. Co., Ltd.) | 30.0 parts |
| Methyl ethyl ketone | 532.0 parts |
| Toluene | 532.0 parts |

EXAMPLE 63

A heat resistant slipping layer-formed sheet of Example 63 was prepared in the same manner as in Example 20 except that the coating liquid A for a heat resistant slipping layer was changed to a coating liquid r for a heat resistant slipping layer having the following composition to form a heat resistant slipping layer.

| <Coating liquid r for heat resistant slipping layer> | |
|---|---|
| CAB resin (CAB 500-5, solid content 100% by weight, manufactured by Eastman Chemical Company) | 100.0 parts |
| Zinc stearyl phosphate (SZ-PF, solid content 100% by weight; manufactured by Sakai Chemical Industry Co., Ltd.) | 5.0 parts |
| Silicone modified acrylic resin (Symac US-380, solid content 30% by weight, manufactured by TOAGOSEI Co., Ltd.) | 16.7 parts |
| Talc (MICRO ACE P-3, solid content 100% by weight; manufactured by Nippon Talc Co., Ltd.) | 5.0 parts |
| Methyl ethyl ketone | 484.5 parts |
| Toluene | 484.5 parts |

EXAMPLE 64

A heat resistant slipping layer-formed sheet of Example 64 was prepared in the same manner as in Example 20 except that the coating liquid A for a heat resistant slipping layer was changed to a coating liquid s for a heat resistant slipping layer having the following composition to form a heat resistant slipping layer.

| <Coating liquid s for heat resistant slipping layer> | |
|---|---|
| CAB resin (CAB 531-1, solid content 100% by weight, manufactured by Eastman Chemical Company) | 100.0 parts |
| Zinc stearyl phosphate (SZ-PF, solid content 100% by weight; manufactured by Sakai Chemical Industry Co., Ltd.) | 5.0 parts |
| Silicone modified acrylic resin (Symac US-380, solid content 30% by weight, manufactured by TOAGOSEI Co., Ltd.) | 16.7 parts |
| Talc (MICRO ACE P-3, solid content 100% by weight; manufactured by Nippon Talc Co., Ltd.) | 5.0 parts |
| Methyl ethyl ketone | 484.5 parts |
| Toluene | 484.5 parts |

EXAMPLE 65

A heat resistant slipping layer-formed sheet of Example 65 was prepared in the same manner as in Example 20 except that the coating liquid A for a heat resistant slipping layer was changed to a coating liquid t for a heat resistant slipping layer having the following composition to form a heat resistant slipping layer.

| <Coating liquid t for heat resistant slipping layer> | |
|---|---|
| CAB resin (CAB 551-0.01, solid content 100% by weight, manufactured by Eastman Chemical Company) | 95.0 parts |
| Acrylic resin (DIANAL BR-83, solid content 100% by weight, manufactured by MITSUBISHI RAYON Co., Ltd.) | 5.0 parts |
| Zinc stearyl phosphate (SZ-PF, solid content 100% by weight; manufactured by Sakai Chemical Industry Co., Ltd.) | 5.0 parts |
| Silicone modified acrylic resin (Symac US-380, solid content 30% by weight, manufactured by TOAGOSEI Co., Ltd.) | 16.7 parts |
| Talc (MICRO ACE P-3, solid content 100% by weight; manufactured by Nippon Talc Co., Ltd.) | 5.0 parts |
| Methyl ethyl ketone | 484.5 parts |
| Toluene | 484.5 parts |

COMPARATIVE EXAMPLE 14

A heat resistant slipping layer-formed sheet of Comparative Example 14 was prepared in the same manner as in Example 20 except that the coating liquid A for a heat resistant slipping layer was changed to a coating liquid v for a heat resistant slipping layer having the following composition to form a heat resistant slipping layer.

| <Coating liquid v for heat resistant slipping layer> | |
|---|---|
| Acrylic resin (DIANAL BR-83, solid content 100% by weight, manufactured by MITSUBISHI RAYON Co., Ltd.) | 100.0 parts |
| Zinc stearyl phosphate (SZ-PF, solid content 100% by weight; manufactured by Sakai Chemical Industry Co., Ltd.) | 5.0 parts |
| Silicone modified acrylic resin (Symac US-380, solid content 30% by weight, manufactured by TOAGOSEI Co., Ltd.) | 16.7 parts |
| Talc (MICRO ACE P-3, solid content 100% by weight; manufactured by Nippon Talc Co., Ltd.) | 5.0 parts |
| Methyl ethyl ketone | 484.5 parts |
| Toluene | 484.5 parts |

COMPARATIVE EXAMPLE 15

A heat resistant slipping layer-formed sheet of Comparative Example 15 was prepared in the same manner as in Example 20 except that the coating liquid A for a heat resistant slipping layer was changed to a coating liquid w for a heat resistant slipping layer having the following composition to form a heat resistant slipping layer.

| <Coating liquid w for heat resistant slipping layer> | |
|---|---|
| Acrylic resin (DIANAL BR-83, solid content 100% by weight, manufactured by MITSUBISHI RAYON Co., Ltd.) | 100.0 parts |
| Zinc stearyl phosphate (SZ-PF, solid content 100% by weight; manufactured by Sakai Chemical Industry Co., Ltd.) | 5.0 parts |
| Silicone modified acrylic resin (Symac US-380, solid content 30% by weight, manufactured by TOAGOSEI Co., Ltd.) | 16.7 parts |
| Talc (MICRO ACE P-3, solid content 100% by weight; manufactured by Nippon Talc Co., Ltd.) | 5.0 parts |

-continued

| <Coating liquid w for heat resistant slipping layer> | |
|---|---|
| Isocyanate compound (CROSSNATE D-70, solid content 50% by weight; manufactured by Dainichiseika Color & Chemicals Mfg. Co., Ltd.) | 30.0 parts |
| Methyl ethyl ketone | 540.5 parts |
| Toluene | 540.5 parts |

COMPARATIVE EXAMPLE 16

A heat resistant slipping layer-formed sheet of Comparative Example 16 was prepared in the same manner as in Example 20 except that the coating liquid A for a heat resistant slipping layer was changed to a coating liquid x for a heat resistant slipping layer having the following composition to form a heat resistant slipping layer.

| <Coating liquid x for heat resistant slipping layer> | |
|---|---|
| Polyvinyl acetal resin (S-LEC KS-1, solid content 100% by weight; manufactured by SEKISUI CHEMICAL Co., Ltd.) | 100.0 parts |
| Zinc stearyl phosphate (SZ-PF, solid content 100% by weight; manufactured by Sakai Chemical Industry Co., Ltd.) | 5.0 parts |
| Silicone modified acrylic resin (Symac US-380, solid content 30% by weight, manufactured by TOAGOSEI Co., Ltd.) | 16.7 parts |
| Talc (MICRO ACE P-3, solid content 100% by weight; manufactured by Nippon Talc Co., Ltd.) | 5.0 parts |
| Methyl ethyl ketone | 484.5 parts |
| Toluene | 484.5 parts |

COMPARATIVE EXAMPLE 17

A heat resistant slipping layer-formed sheet of Comparative Example 17 was prepared in the same manner as in Example 20 except that the coating liquid A for a heat resistant slipping layer was changed to a coating liquid y for a heat resistant slipping layer having the following composition to form a heat resistant slipping layer.

| <Coating liquid y for heat resistant slipping layer> | |
|---|---|
| Polyvinyl acetal resin (S-LEC KS-1, solid content 100% by weight; manufactured by SEKISUI CHEMICAL Co., Ltd.) | 100.0 parts |
| Zinc stearyl phosphate (SZ-PF, solid content 100% by weight; manufactured by Sakai Chemical Industry Co., Ltd.) | 5.0 parts |
| Silicone modified acrylic resin (Symac US-380, solid content 30% by weight, manufactured by TOAGOSEI Co., Ltd.) | 16.7 parts |
| Talc (MICRO ACE P-3, solid content 100% by weight; manufactured by Nippon Talc Co., Ltd.) | 5.0 parts |
| Isocyanate compound (CROSSNATE D-70, solid content 50% by weight; manufactured by Dainichiseika Color & Chemicals Mfg. Co., Ltd.) | 30.0 parts |
| Methyl ethyl ketone | 540.5 parts |
| Toluene | 540.5 parts |

COMPARATIVE EXAMPLE 18

A heat resistant slipping layer-formed sheet of Comparative Example 18 was prepared in the same manner as in Example 20 except that the coating liquid A for a heat resistant slipping layer was changed to a coating liquid z for a heat resistant slipping layer having the following composition to form a heat resistant slipping layer.

| <Coating liquid z for heat resistant slipping layer> | |
|---|---|
| Cellulose acetate propionate [CAP] resin (CAP 504-0.2, solid content 100% by weight; manufactured by Eastman Chemical Company) | 100.0 parts |
| Zinc stearyl phosphate (SZ-PF, solid content 100% by weight; manufactured by Sakai Chemical Industry Co., Ltd.) | 5.0 parts |
| Silicone modified acrylic resin (Symac US-380, solid content 30% by weight, manufactured by TOAGOSEI Co., Ltd.) | 16.7 parts |
| Talc (MICRO ACE P-3, solid content 100% by weight; manufactured by Nippon Talc Co., Ltd.) | 5.0 parts |
| Methyl ethyl ketone | 484.5 parts |
| Toluene | 484.5 parts |

COMPARATIVE EXAMPLE 19

A heat resistant slipping layer-formed sheet of Comparative Example 19 was prepared in the same manner as in Example 20 except that the coating liquid A for a heat resistant slipping layer was changed to a coating liquid A-1 for a heat resistant slipping layer having the following composition to form a heat resistant slipping layer.

| <Coating liquid A-1 for heat resistant slipping layer> | |
|---|---|
| CAP resin (CAP 504-0.2, solid content 100% by weight; manufactured by Eastman Chemical Company) | 75.0 parts |
| Acrylic resin (DIANAL BR-83, solid content 100% by weight, manufactured by MITSUBISHI RAYON Co., Ltd.) | 25.0 parts |
| Zinc stearyl phosphate (SZ-PF, solid content 100% by weight; manufactured by Sakai Chemical Industry Co., Ltd.) | 5.0 parts |
| Silicone modified acrylic resin (Symac US-380, solid content 30% by weight, manufactured by TOAGOSEI Co., Ltd.) | 16.7 parts |
| Talc (MICRO ACE P-3, solid content 100% by weight; manufactured by Nippon Talc Co., Ltd.) | 5.0 parts |
| Methyl ethyl ketone | 484.5 parts |
| Toluene | 484.5 parts |

COMPARATIVE EXAMPLE 20

A heat resistant slipping layer-formed sheet of Comparative Example 20 was prepared in the same manner as in Example 20 except that the coating liquid A for a heat resistant slipping layer was changed to a coating liquid A-2 for a heat resistant slipping layer having the following composition to form a heat resistant slipping layer.

| <Coating liquid A-2 for heat resistant slipping layer> | |
|---|---|
| Nitrocellulose (H1/2, solid content 70% by weight; manufactured by TAIHEI CHEMICALS Ltd.) | 142.9 parts |
| Zinc stearyl phosphate (SZ-PF, solid content 100% by weight; manufactured by Sakai Chemical Industry Co., Ltd.) | 5.0 parts |

-continued

| <Coating liquid A-2 for heat resistant slipping layer> | |
|---|---|
| Silicone modified acrylic resin (Symac US-380, solid content 30% by weight, manufactured by TOAGOSEI Co., Ltd.) | 16.7 parts |
| Talc (MICRO ACE P-3, solid content 100% by weight; manufactured by Nippon Talc Co., Ltd.) | 5.0 parts |
| Methyl ethyl ketone | 463.0 parts |
| Toluene | 463.0 parts |

COMPARATIVE EXAMPLE 21

A heat resistant slipping layer-formed sheet of Comparative Example 21 was prepared in the same manner as in Example 20 except that the coating liquid A for a heat resistant slipping layer was changed to a coating liquid A-3 for a heat resistant slipping layer having the following composition to form a heat resistant slipping layer.

| <Coating liquid A-3 for heat resistant slipping layer> | |
|---|---|
| Nitrocellulose (H1/2, solid content 70% by weight; manufactured by TAIHEI CHEMICALS Ltd.) | 107.1 parts |
| Acrylic resin (DIANAL BR-83, solid content 100% by weight, manufactured by MITSUBISHI RAYON Co., Ltd.) | 25.0 parts |
| Zinc stearyl phosphate (SZ-PF, solid content 100% by weight; manufactured by Sakai Chemical Industry Co., Ltd.) | 5.0 parts |
| Silicone modified acrylic resin (Symac US-380, solid content 30% by weight, manufactured by TOAGOSEI Co., Ltd.) | 16.7 parts |
| Talc (MICRO ACE P-3, solid content 100% by weight; manufactured by Nippon Talc Co., Ltd.) | 5.0 parts |
| Methyl ethyl ketone | 468.0 parts |
| Toluene | 468.0 parts |

COMPARATIVE EXAMPLE 22

A heat resistant slipping layer-formed sheet of Comparative Example 22 was prepared in the same manner as in Example 20 except that the coating liquid A for a heat resistant slipping layer was changed to a coating liquid A-4 for a heat resistant slipping layer having the following composition to form a heat resistant slipping layer.

| <Coating liquid A-4 for heat resistant slipping layer> | |
|---|---|
| CAB resin (CAB 321-0.1, solid content 100% by weight, manufactured by Eastman Chemical Company) | 100.0 parts |
| Zinc stearyl phosphate (SZ-PF, solid content 100% by weight; manufactured by Sakai Chemical Industry Co., Ltd.) | 5.0 parts |
| Silicone modified acrylic resin (Symac US-380, solid content 30% by weight, manufactured by TOAGOSEI Co., Ltd.) | 16.7 parts |
| Talc (MICRO ACE P-3, solid content 100% by weight; manufactured by Nippon Talc Co., Ltd.) | 5.0 parts |
| Methyl ethyl ketone | 484.5 parts |
| Toluene | 484.5 parts |

COMPARATIVE EXAMPLE 23

A heat resistant slipping layer-formed sheet of Comparative Example 23 was prepared in the same manner as in Example 20 except that the coating liquid A for a heat resistant slipping layer was changed to a coating liquid A-5 for a heat resistant slipping layer having the following composition to form a heat resistant slipping layer.

| <Coating liquid A-5 for heat resistant slipping layer> | |
|---|---|
| CAB resin (CAB 321-0.1, solid content 100% by weight, manufactured by Eastman Chemical Company) | 75.0 parts |
| Acrylic resin (DIANAL BR-83, solid content 100% by weight, manufactured by MITSUBISHI RAYON Co., Ltd.) | 25.0 parts |
| Zinc stearyl phosphate (SZ-PF, solid content 100% by weight; manufactured by Sakai Chemical Industry Co., Ltd.) | 5.0 parts |
| Silicone modified acrylic resin (Symac US-380, solid content 30% by weight, manufactured by TOAGOSEI Co., Ltd.) | 16.7 parts |
| Talc (MICRO ACE P-3, solid content 100% by weight; manufactured by Nippon Talc Co., Ltd.) | 5.0 parts |
| Methyl ethyl ketone | 484.5 parts |
| Toluene | 484.5 parts |

COMPARATIVE EXAMPLE 24

A heat resistant slipping layer-formed sheet of Comparative Example 24 was prepared in the same manner as in Example 20 except that the coating liquid A for a heat resistant slipping layer was changed to a coating liquid A-6 for a heat resistant slipping layer having the following composition to form a heat resistant slipping layer.

| <Coating liquid A-6 for heat resistant slipping layer> | |
|---|---|
| CAB resin (CAB 381-0.1, solid content 100% by weight, manufactured by Eastman Chemical Company) | 75.0 parts |
| Acrylic resin (DIANAL BR-83, solid content 100% by weight, manufactured by MITSUBISHI RAYON Co., Ltd.) | 25.0 parts |
| Zinc stearyl phosphate (SZ-PF, solid content 100% by weight; manufactured by Sakai Chemical Industry Co., Ltd.) | 5.0 parts |
| Silicone modified acrylic resin (Symac US-380, solid content 30% by weight, manufactured by TOAGOSEI Co., Ltd.) | 16.7 parts |
| Talc (MICRO ACE P-3, solid content 100% by weight; manufactured by Nippon Talc Co., Ltd.) | 5.0 parts |
| Methyl ethyl ketone | 484.5 parts |
| Toluene | 484.5 parts |

Each of Examples 20 to 65 and Comparative Examples 14 to 24 were evaluated by methods described below.

(Evaluation of Dye Transfer (Kick) to Heat Resistant Slipping Layer)

Each of the heat resistant slipping layer-formed sheets of Examples 20 to 65 and Comparative Examples 14 to 24 and each of the following color material layers were opposed to each other in such a manner that the heat resistant slipping layer contacts with the color material layer, and a load of 20 kg/cm$^2$ was applied to the color material layer and these sheets were stored for 96 hours under the circumstances of 40° C., humidity 20%. Thereafter, the dye transfer to the heat resistant slipping layer of the heat resistant slipping layer-formed sheet was observed to evaluate the heat resistant slipping layer-formed sheet according to the following criteria. As the color material layer, a magenta portion of a color ink/paper set KP-36IP (trade name) manufactured by Canon Inc. was used.

Excellent: A color difference ΔE*ab between the heat resistant slipping layers before and after being opposed to the color material layer is less than 2.0.

Good: A color difference ΔE*ab between the heat resistant slipping layers before and after being opposed to the color material layer is 2.0 or more and less than 4.0.

Poor: A color difference ΔE*ab between the heat resistant slipping layers before and after being opposed to the color material layer is 4.0 or more.

In addition, color hue was measured using GRETAG Spectrolino (D65 light source, viewing angle 2°) manufactured by GRETAG Macbeth AG and a color difference was determined from the following equation.

$$\Delta E^*ab=((\text{difference between } L \text{ values before and after being opposed})^2+(\text{difference between } a \text{ values before and after being opposed})^2+(\text{difference between } b \text{ values before and after being opposed})^2)^{1/2}$$

(Evaluation of Dye Transfer (Back) from Heat Resistant Slipping Layer to Overcoat Layer)

Each of the heat resistant slipping layer-formed sheets to which a dye was kicked by the above method and each of overcoat layers (color ink/paper sets KP-36IP (trade name) manufactured by Canon Inc.) were opposed to each other in such a manner that the heat resistant slipping layer contacts with the overcoat layer, and a load of 20 kg/cm$^2$ was applied to the overcoat layer and these sheets were stored for 24 hours under the circumstances of 60° C., humidity 20%. Thereafter, the surface of the protective layer to which a dye had been transferred was overlaid on the image-receiving surface of an image-receiving paper and images were transferred at 4 mm/sec/line at 105° C. using a laminate testing machine (Lamipacker LPD2305PRO, manufactured by FUJIPLA Inc.). Furthermore, the protective layer was removed from the image-receiving paper, and color hue of a transfer portion was measured using GRETAG Spectrolino (D65 light source, viewing angle 2°) manufactured by GRETAG Macbeth AG to evaluate the heat resistant slipping layer-formed sheet according to the following criteria. As the image-receiving paper, a color ink/paper set KP-36IP (trade name) manufactured by Canon Inc. was used.

Excellent: A color difference ΔE*ab between transferred matters on the overcoat layer before and after a dye was backed is less than 1.5

Good: A color difference ΔE*ab between transferred matters on the protective layer before and after a dye was backed is 1.5 or more and less than 3.0

Poor: A color difference ΔE*ab between transferred matters on the protective layer before and after a dye was backed is 3.0 or more (Evaluation of Ink Pot Life)

50 ml of the coating liquids A to Z, a to z and A-1 to A-6 for a heat resistant slipping layer right after preparation and a stirrer were put in a 110 ml glass container and the coating liquids were left standing for 12 hours and for 24 hours under the circumstances of 30° C., humidity 50% while stirring the coating liquid with a magnetic stirrer, and then states (appearance, viscosity) of the coating liquids were observed.

Excellent: The states of the coating liquid after a lapse of 12 hours and 24 hours do not differ from that of the coating liquid right after preparation.

Good: The state of the coating liquid after a lapse of 12 hours does not differ from that of the coating liquid right after preparation but the state of the coating liquid after a lapse of 24 hours varies (increases in viscosity or the like).

Poor: Both of the states of the coating liquid after a lapse of 12 hours and 24 hours differ from that of the coating liquid right after preparation.

(Evaluation of Suitability for Printing)

A coating liquid for a color material layer, having the following composition, was applied onto a surface opposite to the surface of the heat resistant slipping layer-formed sheets prepared in Examples 20 to 65 and Comparative Examples 14 to 24, on which the heat resistant slipping layer was provided, in such a manner that a dried amount of application was 0.8 g/m$^2$, and the applied coating liquid was dried to prepare a thermal transfer sheet having a color material layer and a heat resistant slipping layer.

| (Coating liquid for color material layer) | |
|---|---|
| C.I. solvent blue 63 | 3.0 parts |
| Polyvinyl butyral resin (S-LEC BX-1, manufactured by SEKISUI CHEMICAL Co., Ltd.) | 3.0 parts |
| Methyl ethyl ketone | 41.0 parts |
| Toluene | 41.0 parts |

Each of the obtained thermal transfer sheet was cut and stuck to a cyan panel portion of a color ink/paper set KP-36IP (trade name) manufactured by Canon Inc. and the thermal transfer sheet was processed together with an image-receiving paper of the color ink/paper set KP-36IP (trade name) manufactured by Canon Inc. with a digital photo-printer CP-200 manufactured by Canon Inc. to evaluate the suitability for printing. Printing was performed at four gray scales of black image (mixed color of yellow of pure medium+magenta of pure medium+cyan of pure medium) of 85/255, 128/255, 192/255, and 255/255 (maximum density) under the two circumstances of 10° C., humidity 20% and 40° C., humidity 90%, and consequently there was no defect of printing in all thermal transfer sheets, circumstances and images.

The results of tests are shown in the following Tables 3, 4.

TABLE 3

| | Kick | Back | Pot life |
|---|---|---|---|
| Example 20 | Good | Excellent | Excellent |
| Example 21 | Good | Excellent | Excellent |
| Example 22 | Good | Excellent | Excellent |
| Example 23 | Good | Excellent | Excellent |
| Example 24 | Good | Good | Excellent |
| Example 25 | Good | Good | Excellent |
| Example 26 | Good | Good | Excellent |
| Example 27 | Good | Good | Excellent |
| Example 28 | Good | Good | Excellent |
| Example 29 | Good | Good | Excellent |
| Example 30 | Good | Good | Excellent |
| Example 31 | Good | Good | Excellent |
| Example 32 | Good | Excellent | Excellent |
| Example 33 | Good | Excellent | Excellent |
| Example 34 | Good | Excellent | Good |
| Example 35 | Good | Excellent | Good |
| Example 36 | Excellent | Good | Excellent |
| Example 37 | Excellent | Good | Excellent |
| Example 38 | Excellent | Excellent | Good |
| Example 39 | Good | Excellent | Excellent |
| Example 40 | Good | Excellent | Excellent |
| Example 41 | Good | Excellent | Good |
| Example 42 | Excellent | Good | Excellent |
| Example 43 | Good | Excellent | Excellent |
| Example 44 | Excellent | Good | Excellent |
| Example 45 | Good | Excellent | Excellent |
| Example 46 | Excellent | Good | Excellent |
| Example 47 | Good | Excellent | Excellent |
| Example 48 | Excellent | Good | Excellent |

TABLE 3-continued

| | Kick | Back | Pot life |
|---|---|---|---|
| Example 49 | Good | Excellent | Excellent |
| Example 50 | Excellent | Good | Excellent |
| Example 51 | Good | Excellent | Excellent |
| Example 52 | Excellent | Good | Excellent |
| Example 53 | Good | Excellent | Excellent |
| Example 54 | Excellent | Good | Excellent |
| Example 55 | Good | Excellent | Excellent |
| Example 56 | Good | Excellent | Excellent |
| Example 57 | Good | Excellent | Excellent |

TABLE 4

| | Kick | Back | Pot life |
|---|---|---|---|
| Example 58 | Poor | Good | Excellent |
| Example 59 | Poor | Good | Good |
| Example 60 | Good | Excellent | Poor |
| Example 61 | Poor | Good | Excellent |
| Example 62 | Good | Good | Poor |
| Example 63 | Poor | Good | Excellent |
| Example 64 | Poor | Good | Excellent |
| Example 65 | Poor | Good | Excellent |
| Comparative Example 14 | Excellent | Poor | Excellent |
| Comparative Example 15 | Excellent | Poor | Poor |
| Comparative Example 16 | Excellent | Poor | Excellent |
| Comparative Example 17 | Excellent | Poor | Poor |
| Comparative Example 18 | Good | Poor | Excellent |
| Comparative Example 19 | Excellent | Poor | Excellent |
| Comparative Example 20 | Poor | Poor | Excellent |
| Comparative Example 21 | Poor | Poor | Excellent |
| Comparative Example 22 | Good | Poor | Excellent |
| Comparative Example 23 | Excellent | Poor | Excellent |
| Comparative Example 24 | Excellent | Poor | Excellent |

The heat resistant slipping layer-formed sheets of Examples 20 to 65 all had good kick of the dye transfer, and among them, the heat resistant slipping layer-formed sheet of Examples 20 to 55 all had low kick and back of the dye transfer and also had high ink stability. On the other hand, Comparative Examples 14 to 24, in which the heat resistant slipping layer-formed sheet is formed of cellulose-based resins other than the CAB resin, were inferior in back. Thus, it is found that thermal transfer sheets capable of suppressing dye transfer can be obtained by disposing a heat resistant slipping layer having the same constitution as in the heat resistant slipping layer-formed sheets of Examples.

INDUSTRIAL APPLICABILITY

Since the thermal transfer sheet of the present invention has the above constitution, it hardly causes a problem that a dye, which has been transferred to the heat resistant slipping layer due to contact under a pressure during storage in a wound state after printing, is retransferred to a transfer protective layer or the like during a rewinding step until the sheet is brought into a product form and thereby printing precision is significantly impaired, and further it has a low friction force and excellent heat resistance.

The invention claimed is:

1. A thermal transfer sheet comprising a base film, a color material layer on one surface of the base film, and a heat resistant slipping layer on the other surface of the base film, wherein the heat resistant slipping layer comprises a binder resin containing a cellulose acetate butyrate resin (A1) having a butyryl group content of 50% or more and a lubricant (B), and wherein the binder resin further contains at least one acrylic resin (A2), the amount of said binder resin is 65 to 99% by weight of the total solid content of the heat resistant slipping layer, the amount of said cellulose acetate butyrate resin (A1) is 60 to 90% by weight of the total weight of said cellulose acetate butyrate resin (A1) and said resin (A2), and the amount of said lubricant (B) is 1 to 30% by weight of said binder resin.

2. The thermal transfer sheet according to claim 1, wherein the heat resistant slipping layer comprises at least one selected from the group consisting of metallic soaps, silicone oils, silicone modified resins, and phosphate esters as a lubricant (B).

3. The thermal transfer sheet according to claim 2, wherein the heat resistant slipping layer comprises fillers.

4. The thermal transfer sheet according to claim 3, wherein in the heat resistant slipping layer, the binder resin is crosslinked by an action of isocyanate.

5. The thermal transfer sheet according to claim 2, wherein in the heat resistant slipping layer, the binder resin is crosslinked by an action of isocyanate.

6. The thermal transfer sheet according to claim 1, wherein the heat resistant slipping layer comprises fillers.

7. The thermal transfer sheet according to claim 6, wherein in the heat resistant slipping layer, the binder resin is crosslinked by an action of isocyanate.

8. The thermal transfer sheet according to claim 1, wherein in the heat resistant slipping layer, the binder resin is crosslinked by an action of isocyanate.

* * * * *